US006330777B1

(12) United States Patent
Padley

(10) Patent No.: US 6,330,777 B1
(45) Date of Patent: Dec. 18, 2001

(54) THREE DIMENSIONAL METAL STRUCTURAL ASSEMBLY AND PRODUCTION METHOD

(75) Inventor: Anthony David Padley, Toronto (CA)

(73) Assignee: TCW Technologies Inc., Toronto (CA)

( * ) Notice: Subject to any disclaimer, the term of this patent is extended or adjusted under 35 U.S.C. 154(b) by 0 days.

(21) Appl. No.: 09/357,232

(22) Filed: Jul. 20, 1999

(51) Int. Cl.[7] ..... E04C 2/42

(52) U.S. Cl. ..... 52/670; 52/635; 52/731.1; 108/51.11

(58) Field of Search ..... 52/670, 262, 635, 52/92.2, 696, 731.1; 29/6.1, 897.31; 108/51.11, 51.3

(56) References Cited

U.S. PATENT DOCUMENTS

| | | | | |
|---|---|---|---|---|
| D. 335,743 | | 5/1993 | Nordstrom . | |
| 2,073,758 | * | 3/1937 | Schmeller, Sr. | 52/670 |
| 2,989,145 | | 6/1961 | Goodloe . | |
| 3,050,831 | | 8/1962 | Diamond . | |
| 3,108,406 | | 10/1963 | Ellis . | |
| 3,342,007 | | 9/1967 | Merson . | |
| 3,583,100 | | 6/1971 | Catalano . | |
| 3,612,813 | | 10/1971 | Gerath . | |
| 3,740,812 | | 6/1973 | Ryan . | |
| 3,756,167 | | 9/1973 | Wilson . | |
| 3,762,344 | * | 10/1973 | Chez | 108/58 |
| 3,763,616 | | 10/1973 | Pasterolli et al. . | |
| 3,812,558 | | 5/1974 | Watanabe . | |
| 3,861,009 | | 1/1975 | Baxter . | |
| 3,872,636 | * | 3/1975 | Nicosia | 52/364 |
| 3,883,026 | * | 5/1975 | Selz | 220/6 |
| 4,240,360 | | 12/1980 | Sanders . | |
| 4,246,737 | | 1/1981 | Eiloart et al. . | |
| 4,295,637 | | 10/1981 | Hulek . | |
| 4,418,558 | | 12/1983 | Simmons . | |
| 4,545,170 | | 10/1985 | Shirley . | |
| 4,955,125 | | 9/1990 | Steinman . | |
| 5,081,814 | | 1/1992 | Singletary et al. . | |
| 5,403,986 | | 4/1995 | Goleby . | |
| 5,451,307 | * | 9/1995 | Bennett et al. | 204/196 |
| 5,460,103 | | 10/1995 | Dunn . | |
| 5,480,254 | * | 1/1996 | Autry et al. | 404/2 |
| 5,524,410 | | 6/1996 | Menchetti . | |
| 5,526,940 | * | 6/1996 | Shea et al. | 211/13 |
| 5,551,135 | | 9/1996 | Powers . | |
| 5,605,024 | | 2/1997 | Sucato et al. . | |
| 5,606,921 | | 3/1997 | Elder . | |
| 5,661,881 | | 9/1997 | Menchetti . | |
| 5,687,653 | | 11/1997 | Bumgarner . | |
| 5,778,626 | | 7/1998 | Hellsten . | |
| 5,787,642 | | 8/1998 | Coyle et al. . | |

FOREIGN PATENT DOCUMENTS

| | | |
|---|---|---|
| 961301 | 1/1975 | (CA) . |
| 2300712 | 11/1976 | (FR) . |
| 1587993 | 4/1981 | (GB) . |

* cited by examiner

*Primary Examiner*—Bruce A. Lev
(74) *Attorney, Agent, or Firm*—Nancy E. Hill; Hill & Schumacher

(57) ABSTRACT

A three-dimensional metal structural assembly includes at least one composite strip having at least one transverse bend therein. The composite strip includes a web having a pair of longitudinal edges and a pair of edge pieces attached to the longitudinal edges. Alternatively a plurality of straight composite strips may be attached together to form a structural element. The composite strip may be used in an almost limitless number of configurations to form such things as pallets, shelves and floor grates. In addition, straight composite strips may be used to form such structural elements as H-shaped beams or C-shaped beams.

36 Claims, 28 Drawing Sheets

THREE DIMENSIONAL METAL STRUCTURAL ASSEMBLY AND PRODUCTION METHOD

FIELD OF THE INVENTION

The invention relates to structural assemblies and in particular, to three-dimensional metal structural assemblies made of a plurality of metal structural elements, that can be used in a variety of load-bearing applications including industrial platforms and pallets.

BACKGROUND OF THE INVENTION

The prior art in this field is voluminous, as considerable effort has been dedicated over the years to the development of improved methods of fabricating metal structural components. For the purposes of the present invention, related prior art can be classified generally into three groups, as described herebelow.

First, it has been recognized in the past that metal structural elements can be made with less metal by eliminating part of the material in areas of lower stress such as the web. Examples of structural members having weight reduced areas are U.S. Pat. No. 3,812,558 (issued on May 28, 1974) to Watanabe, entitled "Method and apparatus for manufacturing expanded structural members and its products"; U.S. Pat. No. 4,418,558 (issued on Dec. 6, 1983) to Simmons entitled, "Method of manufacture of ventilated sheet metal floor members"; U.S. Pat. No. 5,551,135 (issued on Sep. 3, 1996), entitled "Method of fabricating a metal purlin and method of fabricating a building therewith"; U.S. Pat. No. 5,661,881 (issued on Sep. 2, 1997) to Menchetti, entitled "Method of making framing components of expanded metal"; U.S. Pat. No. 5,778,626 (issued on Jul. 14, 1998) to Hellsten, entitled "Closed beam with expanded metal sections".

The principle disadvantage of the approaches illustrated by these patents is that the high stress areas such as flanges or edges are not formed separately from the expanded material. These areas are constructed as an integral part of the parent metal of the structural element. This means that expensive and complex equipment is required to expand the required areas of the element thereby increasing the cost of production. This factor also limits the design of the structural element because the thickness and material of the element in the high stress areas is the same as that used in low stress areas. These disadvantages may explain why this approach to building structural components has never gained much commercial popularity though it has been studied for many years.

Secondly, where edge pieces have been applied to expanded metal to form useful objects, they have been used as frames to enclose and stiffen the expanded metal sheet and have been developed for very specific applications. Examples are, U.S. Pat. No. 3,583,100 (issued on Jun. 8, 1971) to Catalano, entitled "Framed panel"; U.S. Pat. No. 4,955,125 (issued on Sep. 11, 1990) to Steinman, entitled "Method of forming a pizza grille"; U.S. Pat. No. 5,787,642 (issued on Aug. 4, 1998) to Coyle, entitled "Storm shutters with light transmittance".

Among these patents, U.S. Pat. No. 4,955,125 has a donut shaped disc applied around the edge of a circular piece of expanded metal to form a pizza grille. The donut shaped disc is then formed into a "U-shaped" edge piece in order to stiffen the expanded metal and protect the user from any sharp edges. The development of the approach illustrated by these patents has not been expanded to the use of framed strips or sheets of expanded metal as base elements to be formed and assembled into more complex structures. Each of these approaches has a very limited scope and the products are adapted for a specific function.

Thirdly, there have been several patents with approaches to creating or applying structural flanges to webs. Examples are, U.S. Pat. No. 5,403,986 (issued on Apr. 4, 1995) to Goleby, entitled Structural member and method of making by cold rolling followed by induction or resistance welding; and U.S. Pat. No. 4,246,737 (issued on Jan. 27, 1981) to Eiloart, entitled Metal structural members.

The above-mentioned U.S. Pat. No. 5,403,986 discloses hollow flanged structural members created by continuously rolling strips of sheet metal in parallel with the web to form hollow flanges. These flanges are then continuously welded to the web. This patent discloses a beam produced using different materials in high stress areas, however the manufacturing process is complex and therefore would be expensive to produce.

Another example is U.S. Pat. No. 4,246,737 to Eiloart where a flat strip of metal is rolled into an "I-beam" shape by folding the edges of the strip to form flanges and then closing the folded assembly with welds or fasteners. This has the aforementioned difficulties of the material being used in the high stress areas being the same as that in the low stress areas.

None of the above patents employs separate edge pieces assembled together with a lightened central web to be used as a structural element. Rather, those prior art devices discussed above use edge pieces as framing devises only. Further, the above patents do not show a structural element that includes separate edge pieces assembled together with a lightened central web that is bent to form a three-dimensional structure.

Furthermore, the prior art in the field of industrial platforms or pallets is voluminous, as over the years considerable effort has been dedicated to the improving methods for fabricating pallets and industrial platforms. Pallet designs break down into three general groups: namely, grid type pallets, sheet pallets, and wire-form pallets.

In grid type pallets, the structural elements are arrayed into some form of an orthogonal grid or network of spaced ribs or members. Examples are U.S. Pat. No. 5,687,653 (issued on Mar. 15, 1995) to Bumgarner, entitled "Modular metal pallet"; and U.S. Des. Pat. No. 335,743 (issued on Oct. 9, 1991) to Nordstrum, entitled "Loading pallets". The main disadvantage of grid type metal pallets is their great weight. This is why the most popular pallets are manufactured from wood. With a metal construction, weigha disadvantage not only because of the higher transportation cost, but also because of the high production cost.

In wire-form pallets, metal tubing or wire is shaped into co-planar surfaces in such a manner as to support heavy loads and provide open spaces through which to insert the forks of a fork lift truck. Examples are U.S. Pat. No. 3,756,167 (issued on Sep. 4, 1973) to Wilson, entitled "Wire-formed Pallet"; and United Kingdom Patent No.1, 587,993 (issued on Apr. 15, 1981) to Dipalma, entitled "Improvements Relating to Material Handling Pallets". One of the disadvantages of wire as a construction material is the high cost of wire products both to buy and to manufacture relative to sheet products. The above-mentioned U.S. Pat. No. 3,756,167 is a hybrid design but has the disadvantage of poor torsional strength. Low torsional strength results in a short working life due to the high stress and load cycling placed on the connections.

In sheet pallets, sheets of metal or other material are formed into various shapes to form the pallets or industrial platforms. Sheet pallets are generally classified into two sub-groups, either single or multiple sheet construction depending on whether a single sheet of material is used to form the pallet or two or more sheets are assembled to form the pallet. Sheet pallets include the large group of pallets designed to be formed from plastic by injection molding but whose shape is similar to the shapes of deformed sheet materials. Sheet pallets also include pallets formed from corrugated paper sheet material. An example of a pallet of single sheet construction is Canadian Patent No. 961,351 (issued on Jan. 21, 1975) to Morrison, entitled "Pallet and Method of Production".

Examples of pallets of multiple sheet construction are: U.S. Pat. No. 4,240,360 (issued on Dec. 12, 1980) to Sanders, entitled "Stackable Flat Pallet" and U.S. Pat. No. 5,460,103 (issued on Feb. 17, 1992) to Dunn, entitled "Metal Pallet".

The above-mentioned U.S. Pat. No. 4,240,360 to Sanders employs an orthogonal grid of metal strips to support a pierced sheet metal deck that enables the pallets to be stacked. This design however is heavy due to the weight of the full metal sheet used for its deck. The above-mentioned U.S. Des. Pat. No. 335,743 (issued on May 18, 1993) to Nordstrum uses a deck constructed from metal strips. However this design exhibits poor torsional stiffness. This is a major operational drawback as pallets are often heavily loaded and are not treated carefully in operation.

Therefore, it would be advantageous to provide a structural assembly that is more dimensionally stable, thereby enabling easier handling and easier assembly in a variety of ways at a lower construction cost. In addition, it would be advantageous to provide a load-bearing structure that has much greater torsional stiffness and strength than the prior art designs while maintaining a relatively light weight.

SUMMARY OF THE INVENTION

It is a general object of the present invention to provide an improved structural assembly for load-bearing applications. The object of the invention is accomplished by using a structural element made of a lightened central web, such as an expanded metal web, to which separate edge pieces are attached. Further improvements are achieved in that a plurality of such structural elements can be assembled together in order to create a structure that exhibits a stiffness and strength greater than that of the separate elements added together.

In one aspect of the present invention, a three-dimensional metal structural assembly is provided. The structural assembly includes at least one composite strip having at least one transverse bend therein. The composite strip includes a web having a pair of longitudinal edges and a pair of edge pieces attached to the longitudinal edges.

In another aspect of the present invention a plurality of straight composite strips are attached together to form a structural element. Each composite strip includes a web having a pair of longitudinal edges and a pair of edge pieces attached to the longitudinal edges.

In still a further aspect of the present invention a H-shaped structural assembly is provided including a web having a pair of longitudinal edges and a T-shaped pair of edge pieces attached to the longitudinal edges. In an alternative aspect of the present invention a C-shaped structural assembly is provided including a web having a pair of longitudinal edges and a L-shaped pair of edge pieces attached to the longitudinal edges.

The novel and improved structural assembly of the present invention is provided which comprises a plurality of structural elements which are connected to one another. A variety of methods can be used to connect the structural elements, including, but not limited to, welding, riveting or bolting. Each of the structural elements comprises an expanded metal web having longitudinal peripheries and a pair of edge pieces attached along the longitudinal peripheries of the metal web to enclose peripheral edges of the web. The edge pieces not only provide additional rigidity and dimensional stability to what is essentially a "springy" expanded metal and protect users from sharp edges of the expanded metal, but also provide attachment points to facilitate the assembly of a plurality of structural elements. A variety of methods can be used to attach the edge pieces to the web, including, but not limited to, crimping, spot welding and crimping, or riveting.

In accordance with another aspect of the present invention, a structural assembly is provided wherein each of the structural elements is bent in a direction transverse to the edge pieces. The bending of the structural element reinforces the attachment of the expanded metal web to the edge pieces, thereby increasing the structural rigidity and stiffness of the structural element in the metal structural assembly.

In the preferred embodiment, a structural assembly is provided wherein each of the structural elements is bent more than one time at more than one places along its length, each time in a direction transverse to the edge pieces. For example, the structural element may be bent into shape having a square or rectangular cross section.

In a further aspect of the present invention, a composite metal strip is provided that can be used as a structural element to assemble industrial platforms, carriers, box shaped or round containers or other structural applications. The composite metal strip of the present invention comprises an expanded metal web having longitudinal peripheries and a pair of generally U-shaped edge pieces attached along the longitudinal peripheries of said metal web. The composite metal strip of the present invention is characterized in that it is bent in a direction transverse to its edge pieces. Upon bending of the composite metal strip, the edge pieces will crimp, thereby gripping the web tightly at the bend. This facilitates construction of the composite strips and renders them to be used as more efficient and stronger structural elements. In its one embodiment, the composite metal strip is made of elongate composite metal strip. The composite metal strip may be bent at more than one place, each time in a direction transverse to the edge pieces.

Further aspects of the invention are illustrated in the accompanying drawings, and are more fully described in the following specification.

BRIEF DESCRIPTION OF THE DRAWINGS

The drawings will now be described by way of example only to illustrate examples of preferred embodiments of the invention, with reference to the accompanying drawings, in which.

DETAILED DESCRIPTION OF THE INVENTION

Reference will now be made in detail to the presently preferred embodiments of the invention, non-limiting examples of which are shown in the accompanying drawings. These have been selected to illustrate the principle features of the invention. Following is a brief description of two basic examples of present the invention. Thereafter a detailed description of the structural assembly and a plurality of methods of attaching the web piece to the edge pieces. Finally there follows non-limiting examples of more complex structures utilizing the structural assembly of the present invention.

Figure 1:
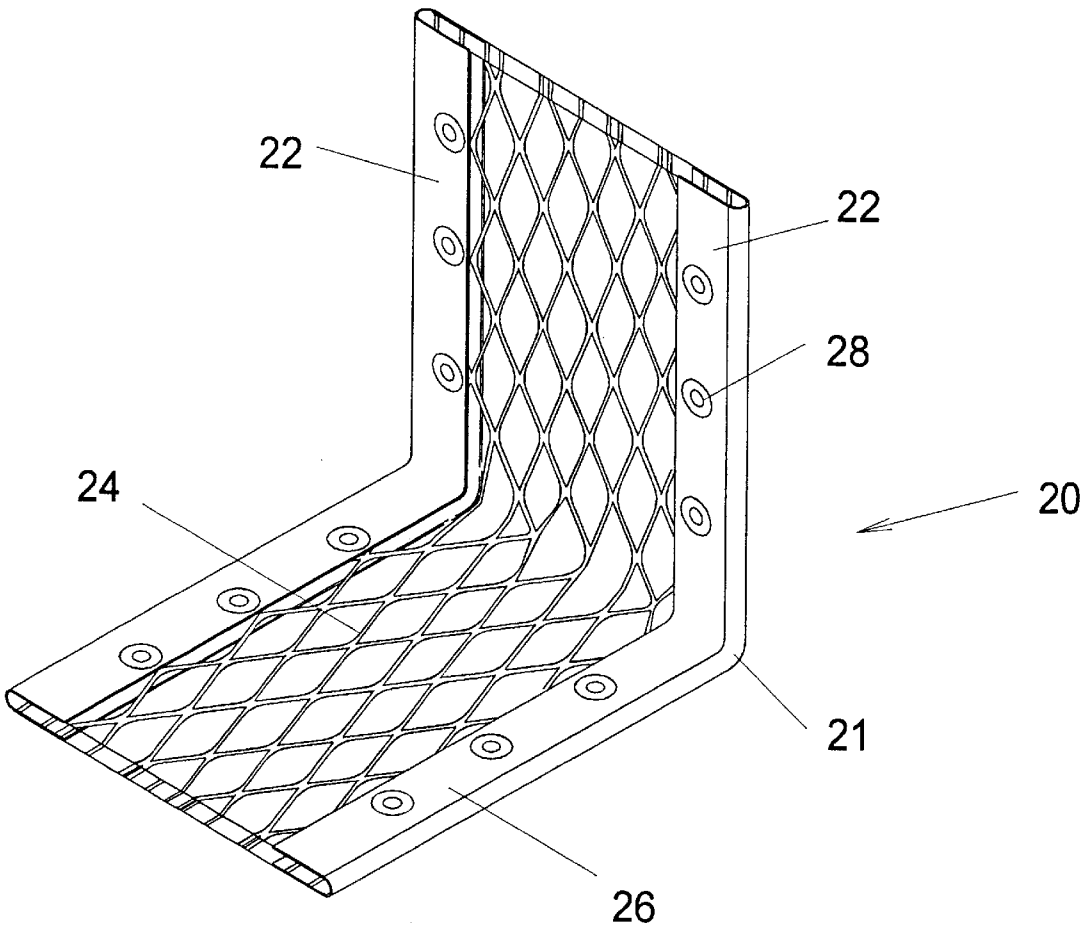
FIG. 1 is a perspective view of a composite strip of the present invention having one transverse bend therein.
Figure 2:
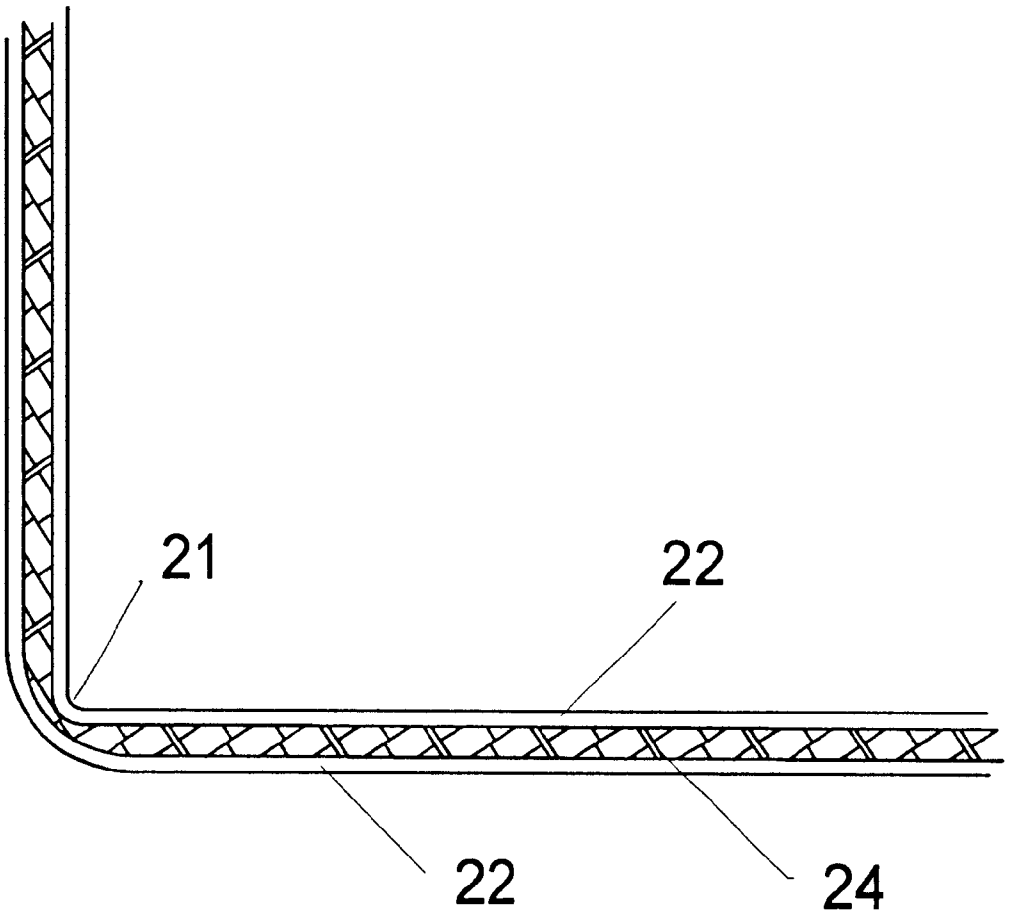
FIG. 2 is a cross sectional view of a transverse bend in a composite strip.
Figure 3:
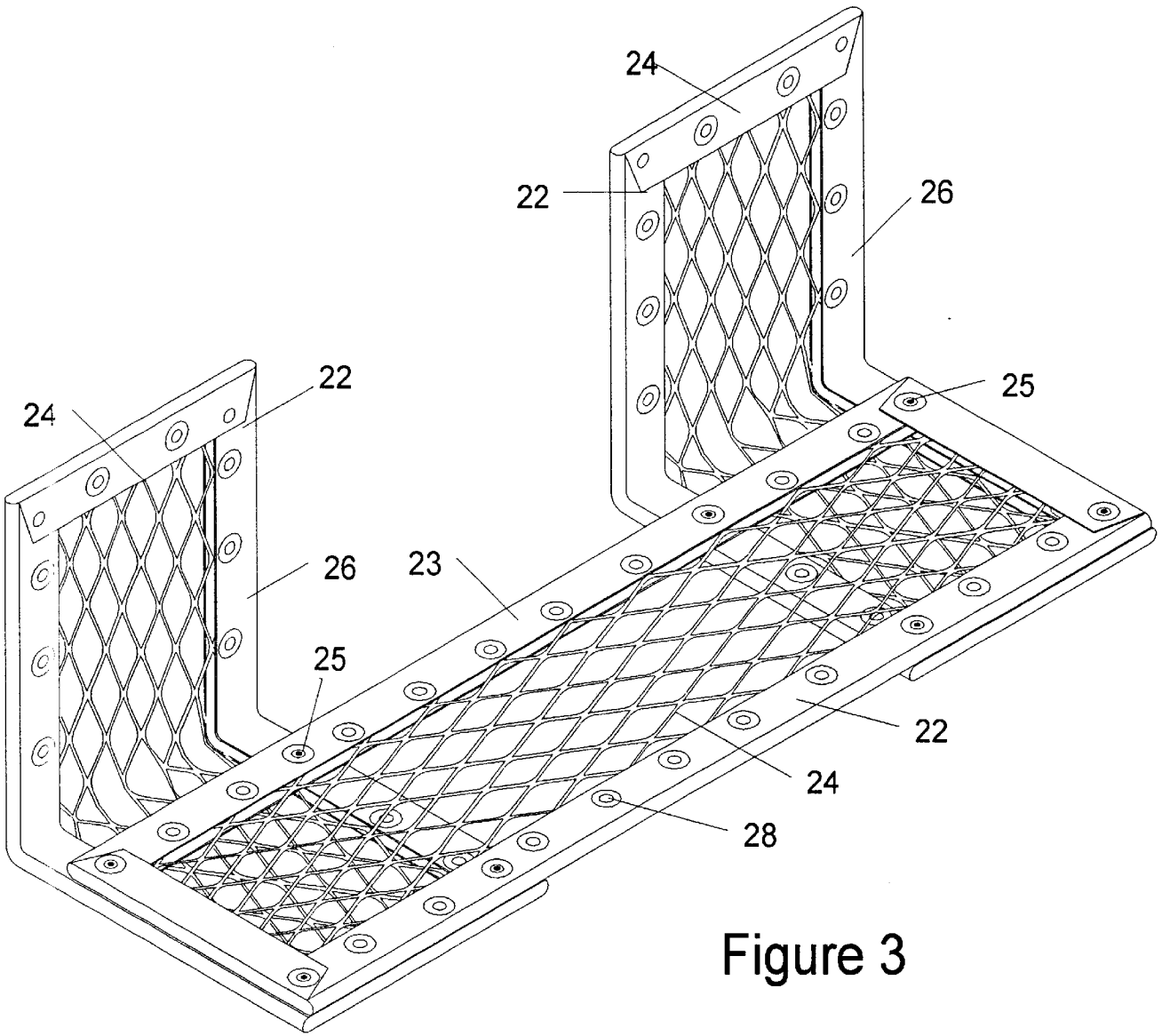
FIG. 3 is a shelf made from two L-shaped composite strips and a flat composite strip.

Referring to the drawings and in particular FIGS. 1 to 4, the elongate composite strip used in the structural assembly according to the present invention is shown generally at 20. The elongate composite strip 20 has two edge pieces 22 and a web piece 24. Optionally edge pieces 22 can be on side edges as well as shown in FIG. 3. The edge pieces 22 are attached to the web 24 by one of a variety of methods such as crimping, spot welding and crimping, or riveting described in more detail below. It will be clear to those skilled in the art that a number of other methods of attaching the edge pieces to the web may be employed. Further it will be clear to those skilled in the art that in some instances no specific method of attachment need be used since a transverse bend 21 in the structural assembly will serve to attach the edge pieces 22 to the web 24. However, preferably one of methods of attachment is used because it will enhance the strength of the structural assembly.

The composite strip 20, shown in FIG. 1, is bent (as shown in FIG. 2) to form a structural element 26, an example of a use for such a structural element is shown in FIG. 3. The shape of the structural element will depend on the use for which the element is required. Bending of the composite strip, in particular transverse bending, into an appropriate shape significantly increases the structural rigidity and stiffness of the strip. Assembling a number of structural elements in a manner that allows them to mutually reinforce each other produces a composite structure of considerable strength and rigidity. An additional novel characteristic of the present invention is that, upon transverse bending of the composite strip 20, the edge pieces 22 will crimp as shown in detail in FIG. 2, thereby gripping the web 24 tightly at the bend 21. This facilitates construction of the composite strips 20 and renders the structural elements stronger than would otherwise be the case.

Referring to FIG. 1, a preferred embodiment of the elongate composite strip 20 has a central web 24 and two opposed, "U-shaped", edge pieces 22. Dimpling 28 is shown at regular intervals along the edge pieces 22. Dimpling 28 is caused by crimping the edge pieces 22 to secure them against the central web 24.

By way of non-limiting example, a relatively basic structure is shown in FIG. 3. The structure includes a pair of L-shaped structural elements 26 similar to those shown in FIG. 1 made from composite strips 20 with one bend therein. The spaced apart L-shaped structural elements are connected by rivets 25 or the like to a straight composite strip 23. This structure could be used as a shelf or in another application as determined by the user.

Figure 4:
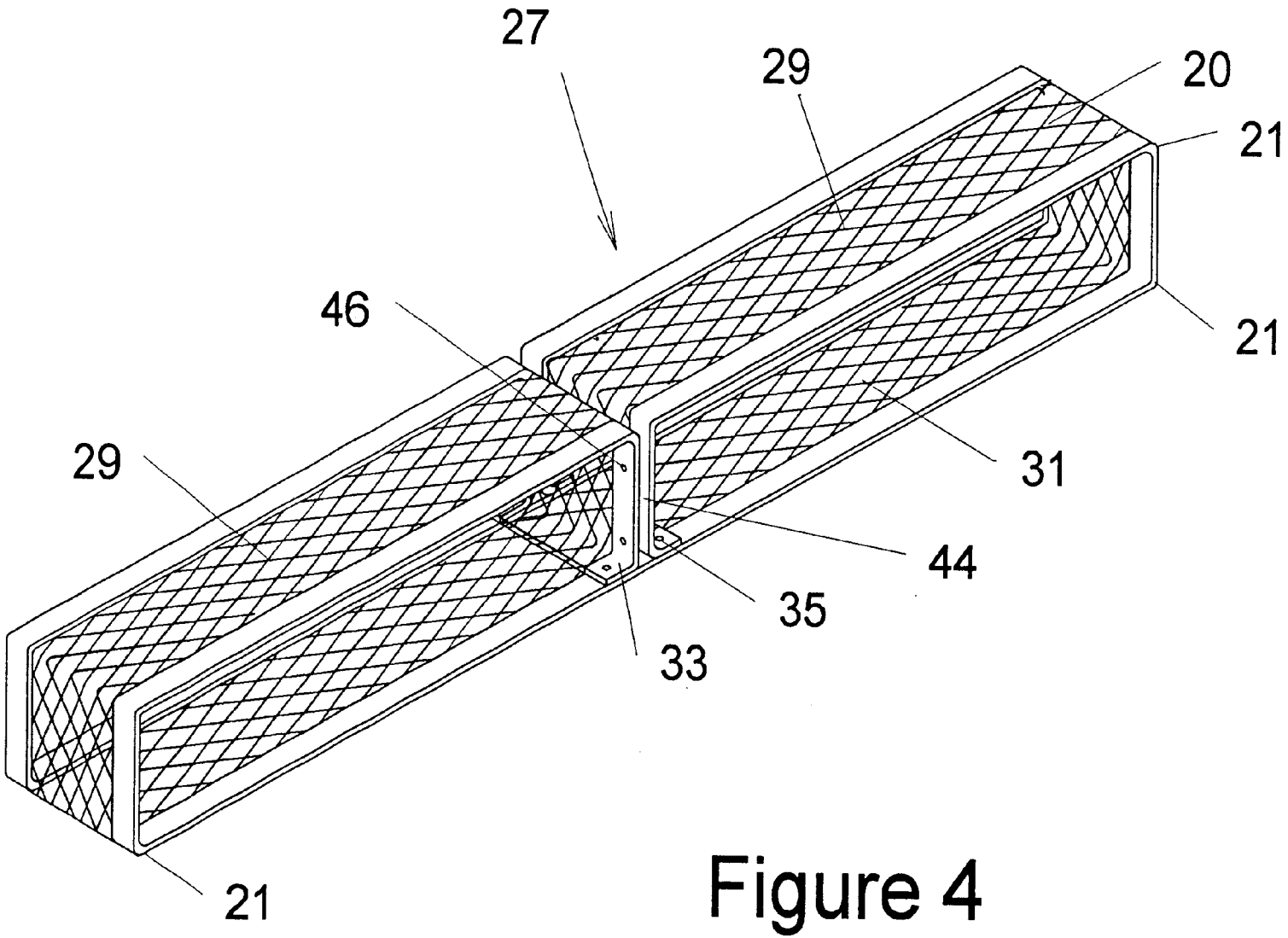
FIG. 4 is a perspective view of a structural element made from one composite strip.

Another non-limiting example is shown in FIG. 4 which illustrates a particularly effective structural element 27 for use in an industrial platform or in a pallet where there is a requirement for openings to permit the insertion of the forks of a forklift truck. The elongate composite strip 20 is bent with a plurality of transverse bends 21. Elongate composite strip is bent such that the end portions 29 meet and together define a plane which is spaced from and parallel to the plane of the central portion 31. One end 33 of composite strip 20 is attached to the other end 35 thereof such that together they form a central support 44. End parts 33 and 35 are connected through a plurality of riveted connections 46 at the longitudinal center of the composite strip 20. Central support helps to hold the structural element 27 in shape, thereby producing a semi-rigid composite structure. It will be clear to those skilled in the art that a variety of methods including, but not limited to, welding, riveting or bolting may be used to produce these connections. Riveted connections are the presently preferred method of connection and these have been shown throughout these drawings.

Figure 5C:
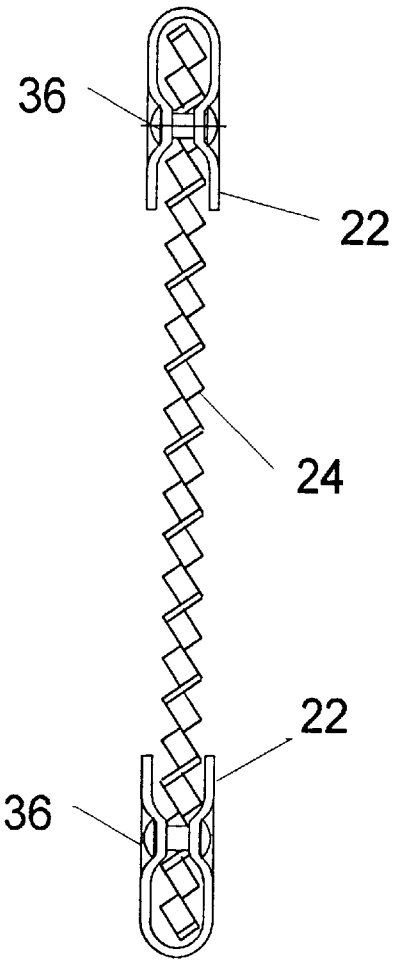
FIG. 5*c* is a cross sectional view of a composite strip showing a crimping and riveting connection between a web and an edge piece.
Figure 5B:
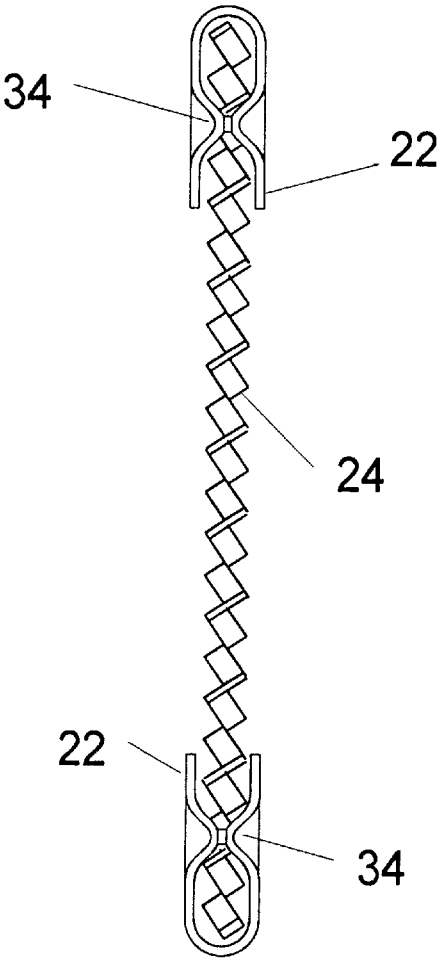
FIG. 5*b* is a cross sectional view of a composite strip showing a crimping and welding connection between a web and an edge piece.
Figure 5A:
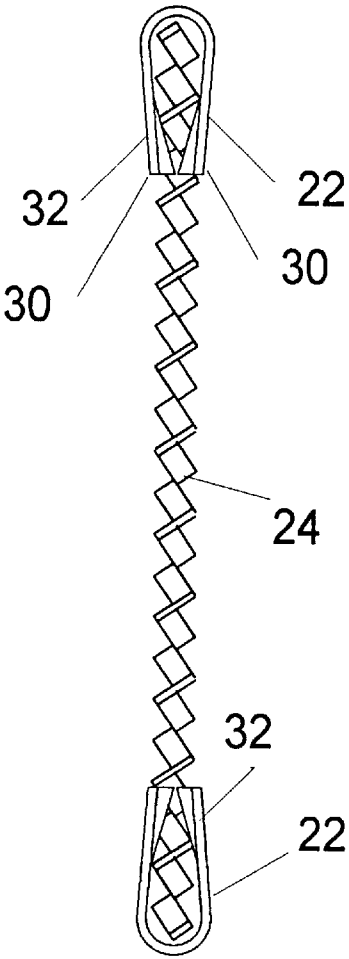
FIG. 5*a* is a cross sectional view of a composite strip showing a crimping connection between a web and an edge piece.
Figure 5F:
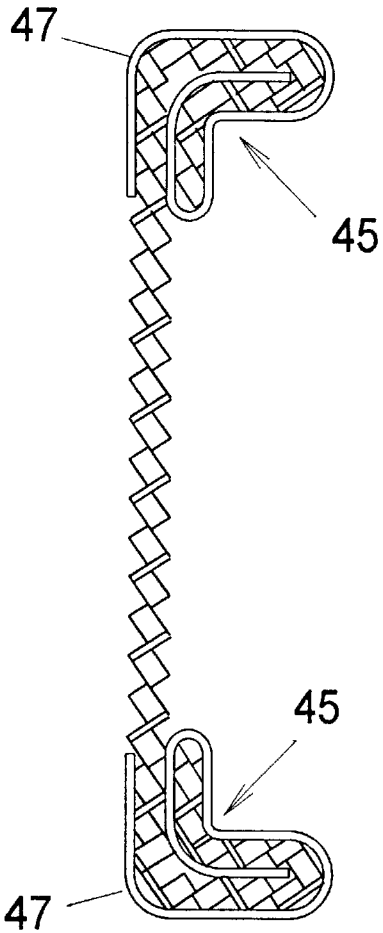
FIG. 5*f* is a cross sectional view of a composite strip showing a bending back and lateral bending connection between a web and an edge piece.
Figure 5E:
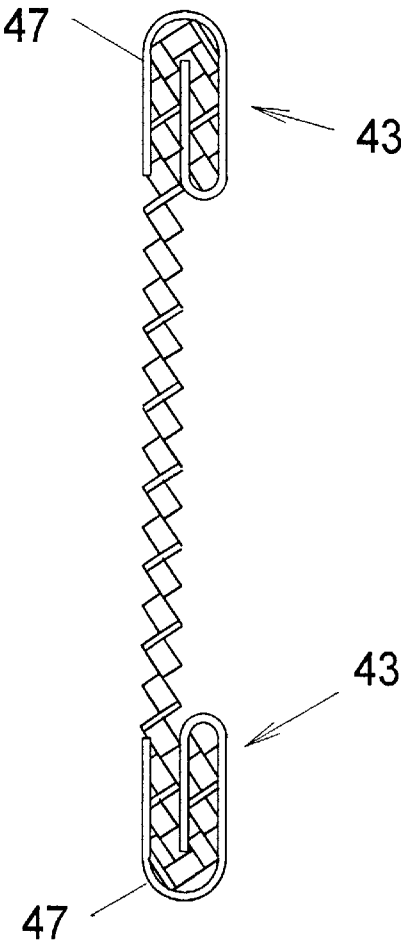
FIG. 5*e* is a cross sectional view of a composite strip showing a bending back connection between a web and an edge piece.
Figure 5D:
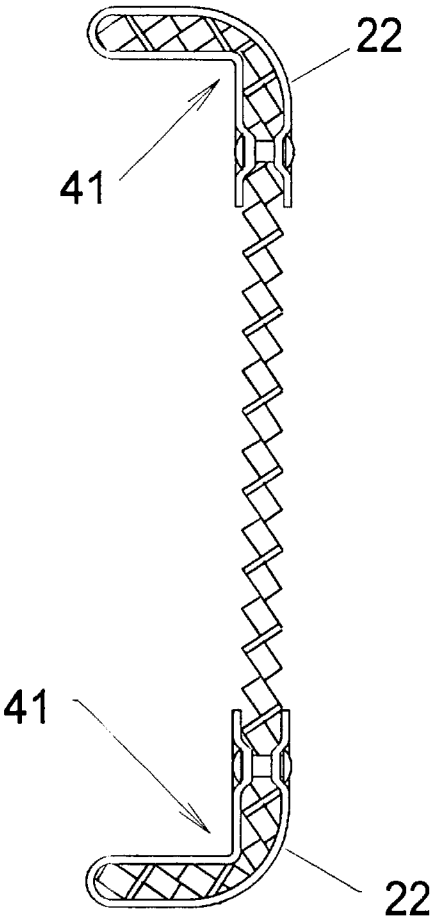
FIG. 5*d* is a cross sectional view of a composite strip showing a crimping, riveting and lateral bending connection between a web and an edge piece.

FIGS. 5*a*–5*f* illustrate a non-exhaustive array of six alternative examples for the attachment of edge pieces 22 to the central web 24. In each example the web 24 extends fully into the U-shaped edge piece 22. The distal ends 30 of U-shaped edge pieces 22 are on either side of web 24 and there are a plurality of methods of attaching the U-shaped edge pieces 22 to the web 24. Simple crimping is shown generally at 32 in FIG. 5*a*; crimping and spot welding is shown generally at 34 in FIG. 5*b*; crimp and riveting is shown generally at 36 in FIG. 5*c*; crimping, riveting and lateral bending is shown generally at 41 in FIG. 5*d*; bending back is shown generally at 43 in FIG. 5*e*; and bending back and lateral bending is shown generally at 45 in FIG. 5*f*. To attach an edge piece 22 to a web 24 by way of crimping, a plurality of spaced apart dimples 28 are formed (as shown in FIG. 1) will be used. Similarly with regard to crimping and spot welding or crimping and riveting a plurality will be used. With regard to crimping, riveting and lateral bending shown in FIG. 5*d* a plurality of spaced apart crimps and rivets will be used. The lateral or L-shaped bend will also aid in the attachment of the edge piece 22 to the web 24. The lateral or L-shaped bend of edge piece 22 is particularly effective in a panel or top deck for use with an industrial platform or pallet. Referring to FIG. 5*e* the edge piece 47 has a shape similar to a lower case "e". The web 24 fits in between the arms of the edge piece 47 and is held therein. The edge piece attachment shown in FIG. 5*f* is similar to that shown in 5*e* but it further includes an L-shaped or lateral bend. This type of bend is particularly effective for a panel or a top deck.

Figure 6C:
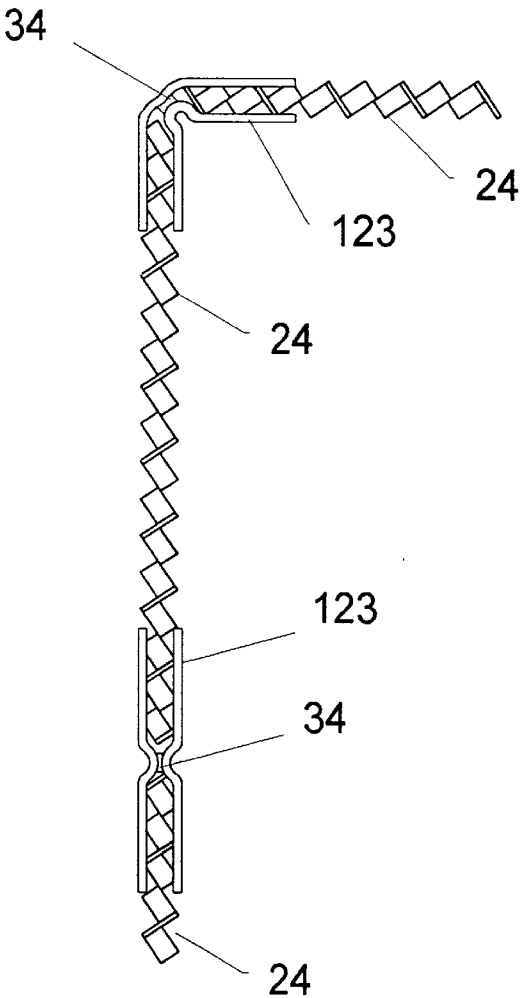
FIG. 6*c* is a cross sectional view of an alternate connection between two web using one edge connection.
Figure 6B:
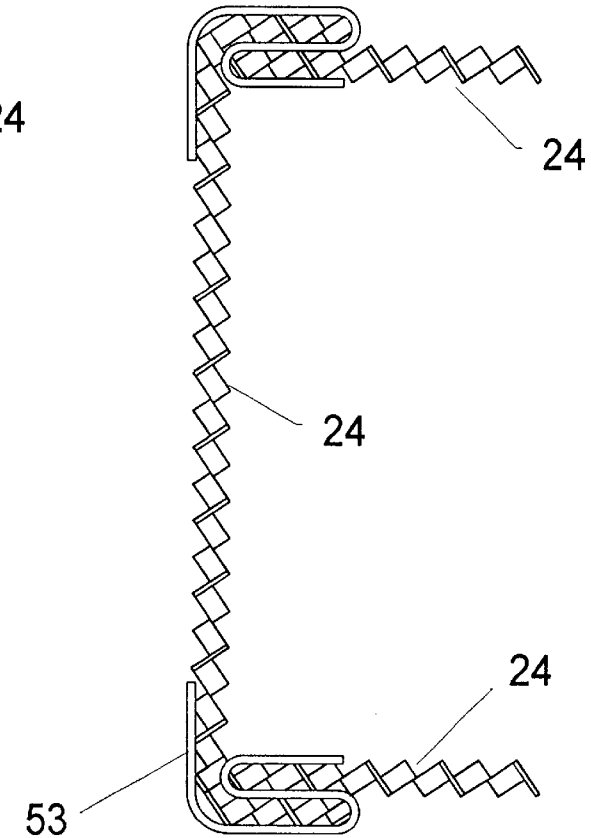
FIG. 6*b* is a cross sectional view of an alternate connection between a panel and a frame using one edge piece.
Figure 6A:
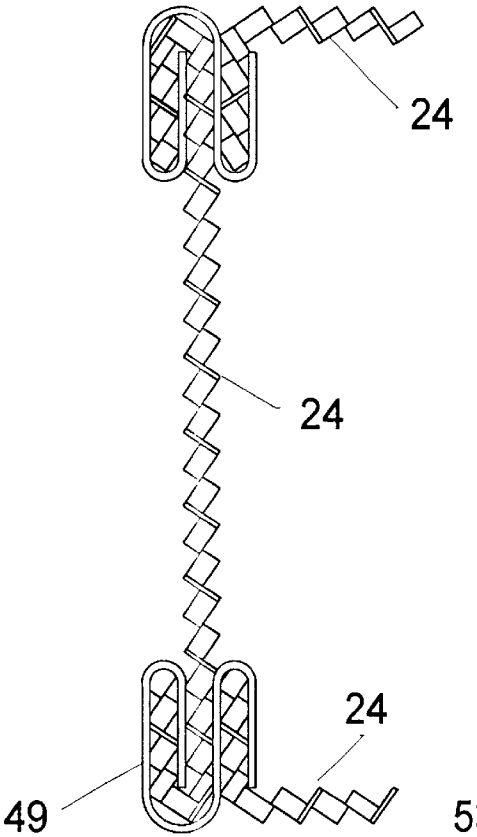
FIG. 6*a* is a cross sectional view of a connection between a panel and a frame using one edge piece.

FIGS. 6*a* and 6*b* illustrate a non-exhaustive methods of attaching a panel to a frame each formed from web using one edge piece. Serpentine S-shape edge piece 49 shown in FIG. 6*a* connects two orthogonal web pieces 24. FIG. 6*b* shows an alternate serpentine L-shaped edge piece 53 which connects two orthogonal web pieces 24. FIG. 6*c* illustrates one possible method of attaching two panels together. Two web pieces 24 are positioned with longitudinal edges abutting each other and a pair of elongate metal strips 123 are positioned on either side of the abutting edges. The elongate metal strips are spot welded 34 together. The two web pieces may then be longitudinally bent as shown at the top of FIG. 6*c*.

FIG. 2 illustrates the effect that occurs when the composite strip is bent whereby the material of the central web is gripped tightly by the crimping of the edge pieces that occurs at the bend 21. This is a key design factor contributing to the structural integrity of the structural elements, particularly for low cost, lightly loaded applications. Accordingly, the attachment of the edge pieces by the methods shown in FIG. 5 may not necessarily be required for lightly loaded applications.

Figure 7:
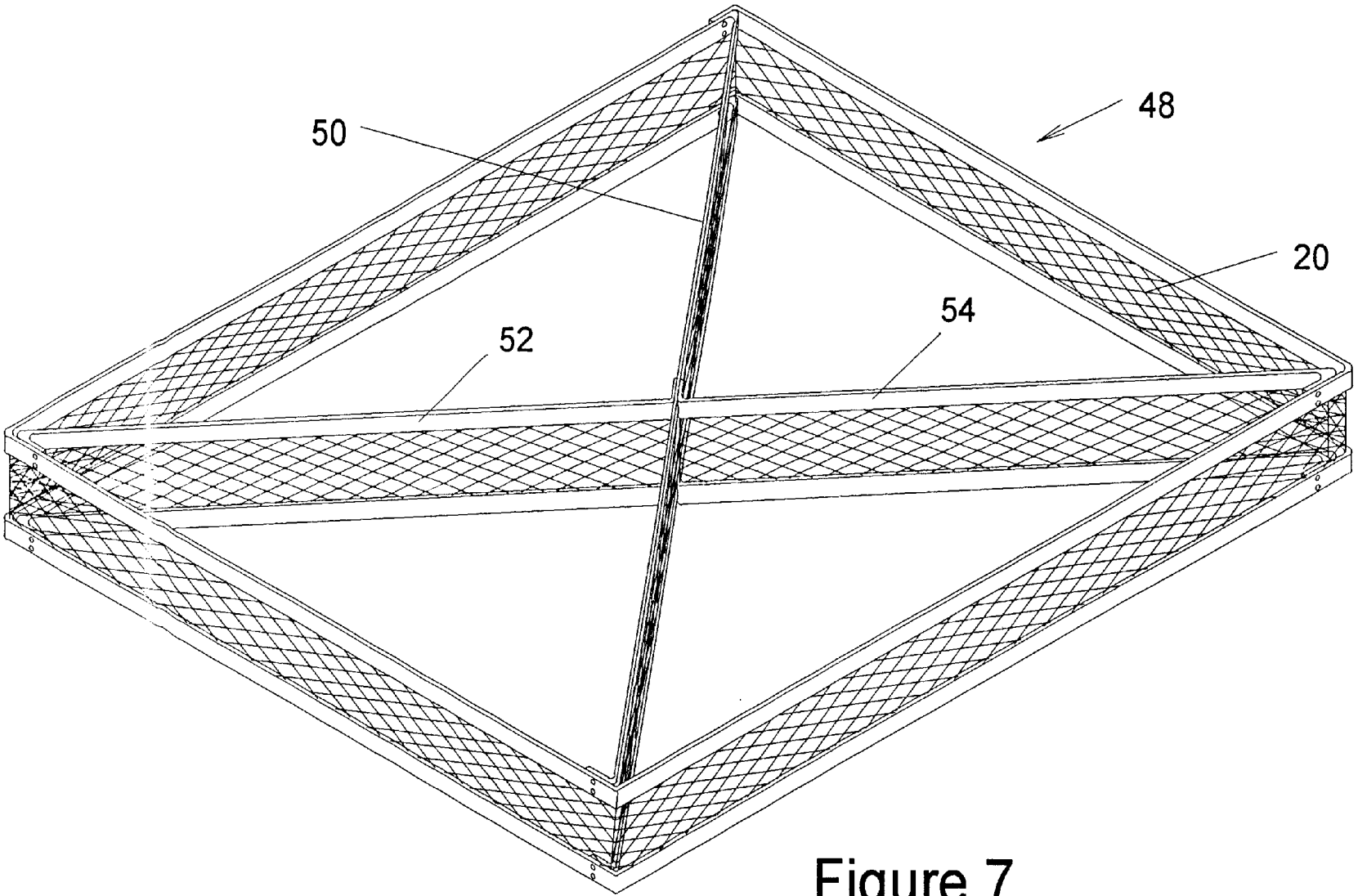
FIG. 7 is a perspective view of a composite structure constructed from a plurality of bent composite strips.
Figure 8:
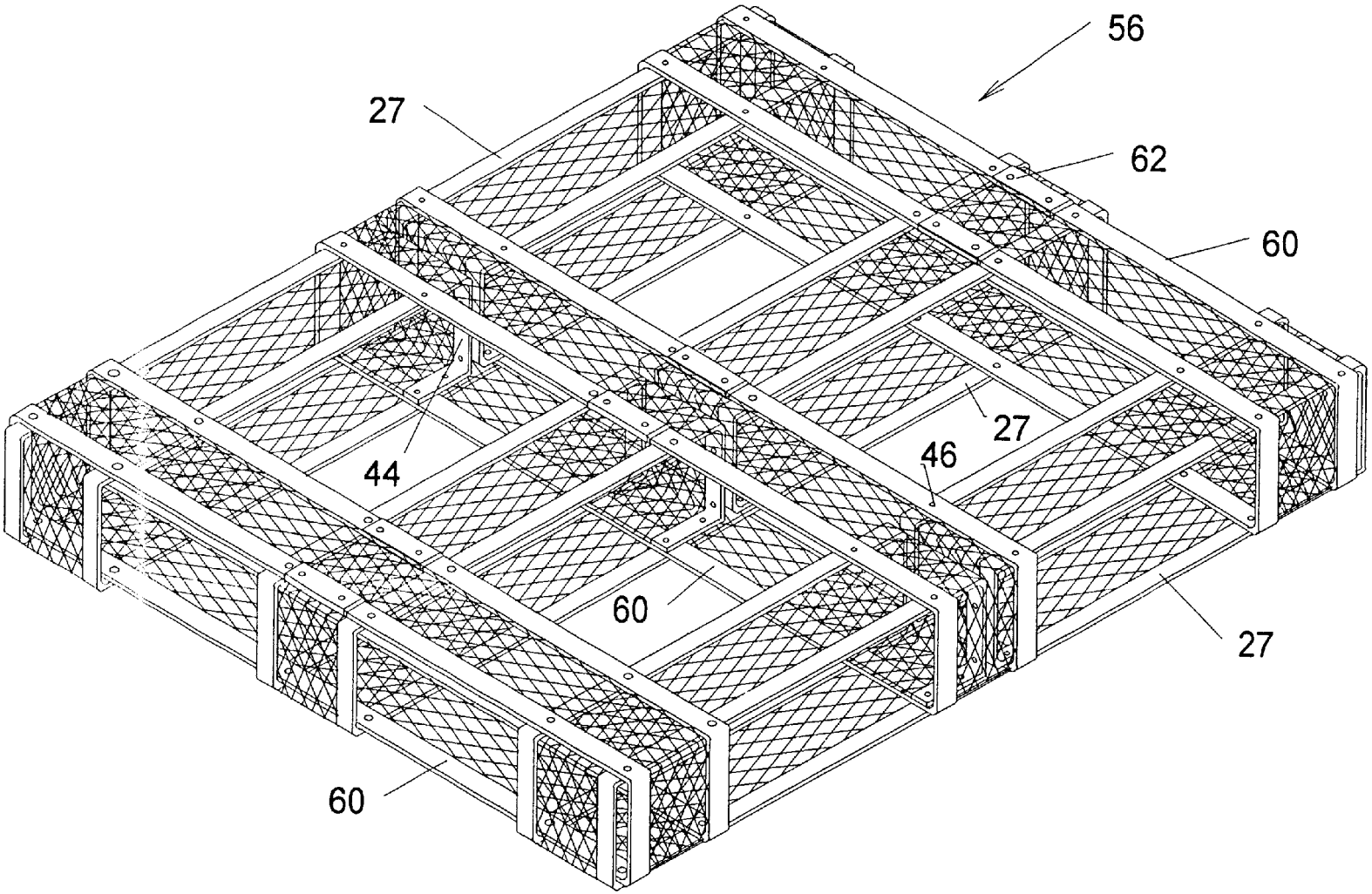
FIG. 8 is a perspective view of an alternate embodiment of a composite structure constructed from a plurality of bent composite strips.

By way of non-limiting examples, FIGS. 7 and 8 illustrate two methods of assembling composite structures from structural elements. It will be clear to those skilled in the art that using these methods, structural elements may be bent in a variety of ways to form composite structures suitable for a range of applications. The methods illustrated here are primarily suitable for industrial platform construction.

FIG. 7 is a box-form assembly 48 where three structural elements are connected to form a torsion box. To assemble the composite structure, the first composite strip 20 is bent at six places to form a generally square structural element 50 bisected by one end of the composited strip. A second and a third composite strips are bent respectively at each end thereof to form structural elements 52 and 54. Structural elements 52 and 54 are bent such that in position they will form a generally straight line, in cross section, which bisects square structural element 50. The assembly is aligned, drilled and riveted to create a rigid composite structure.

FIG. 8 is an assembly 56 where six structural elements are connected to form a grid-form industrial platform or pallet. There are two types of structural elements, 27 and 60, used in this assembly and three of each is used. Structural element 27 is shown in FIG. 4 and has a cross section that is generally an elongate rectangle. Structural element 60 is similar to structural element 27 but it does not have a central support 44. The structural elements 60 have end-to-end connections where a short edge pieces or end to end connectors 62 is placed over adjacent edges of the structural element and connected at its ends forming the end-to-end connection. To assemble the composite structure, the elements are interwoven as shown in FIG. 8. They are then aligned, and drilled and riveted 46 to create a rigid composite structure. Assembly 56 is designed to be suitable for construction of an industrial platform that has openings in its sides to permit the insertion of the forks of a forklift truck. The intersection of the structural elements at the corners of the composite structure provide a rigid moment connection in two planes at each of the corners thus developing an extremely light and rigid platform.

Figure 9:
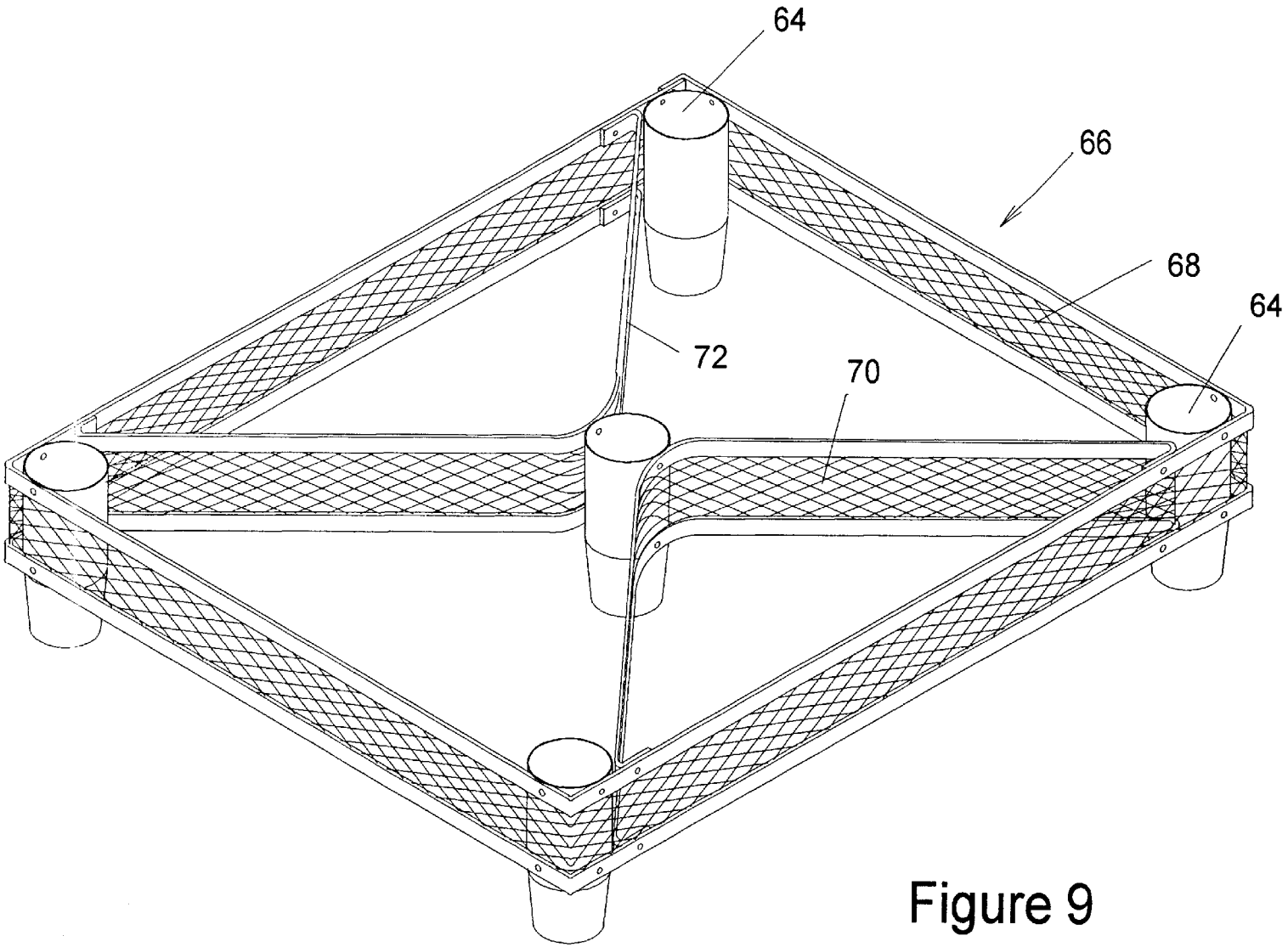
FIG. 9 is a perspective view of an elevated composite structure assembled from a plurality of composite strips and a plurality of tubular elements.
Figure 10:
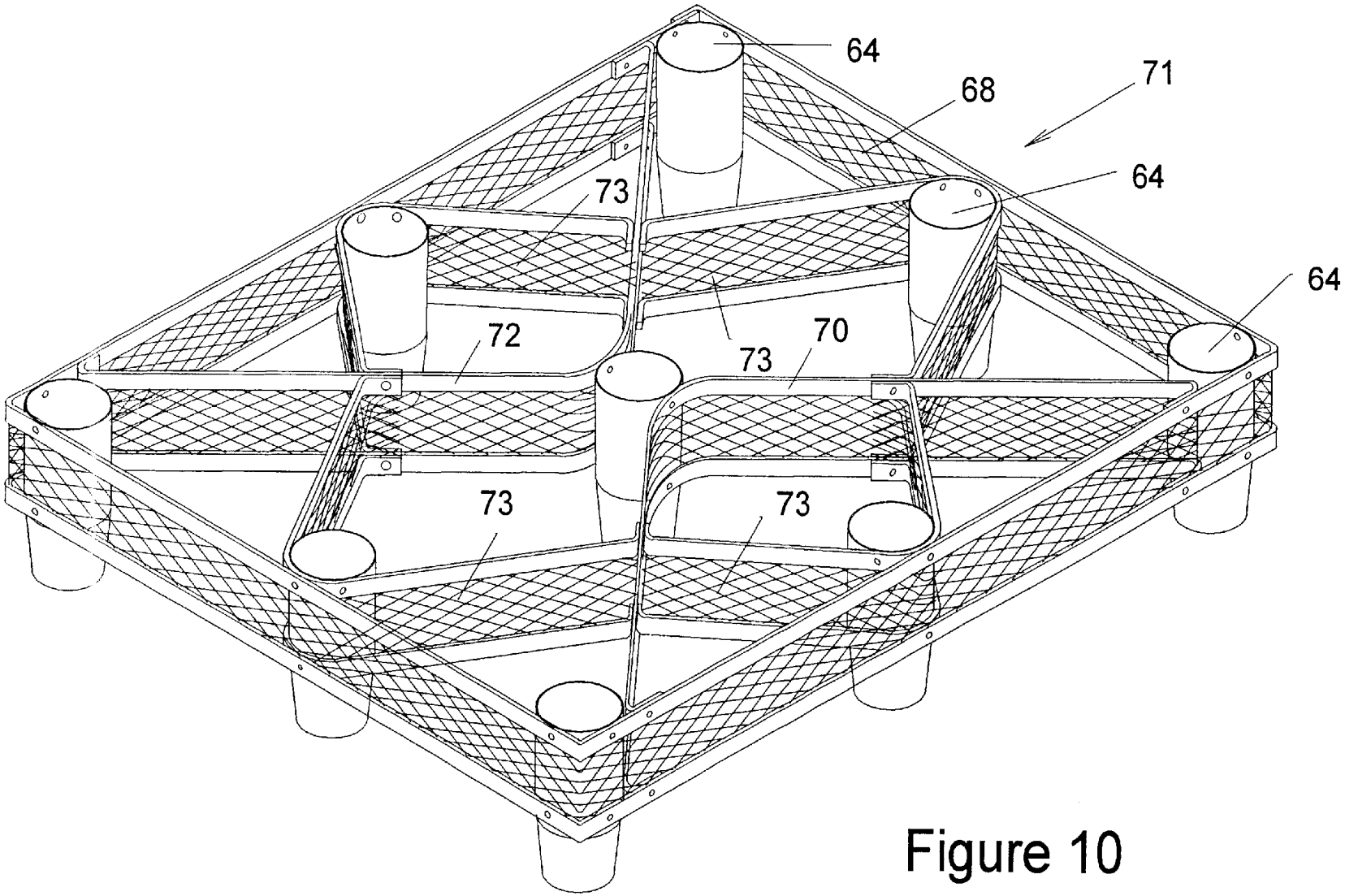
FIG. 10 is a perspective view of an alternate embodiment of an elevated composite structure assembled from a plurality of composite strips and a plurality of tubular elements.

FIGS. 9 and 10 illustrate a more complex embodiment of the invention similar in principle to FIG. 7 except that a plurality of tubular elements 64 have been added to elevate the composite structure platform. The torsion box design has been retained in modified form to allow the positioning of the tubular elements 64. In the example of an industrial platform or pallet this will allow the insertion of the forks of a forklift truck under the composite structure to allow lifting or movement of the platform from place to place. Referring to FIG. 9, platform 66 is made of three elongate composite strips, one of which is bent into a generally square element 68 and two are bent into generally U-shaped elements 70 and 72. The composite structure 66 is assembled with a tubular element 64 at each corner of the square element 68 and a fifth tubular element in the middle between the U-shaped elements 70 and 72. The tubular elements 64 are formed by spin forming or press forming conical ends onto straight tube sections. The structural elements 68, 70 and 72 and the tubular elements 64 are then connected by rivets or the like. Tubular elements 64 of circular cross-section are preferred but it will be clear to those skilled in the art that a variety of shapes including, but not limited to, square, rectangular, triangular or multi-faceted may be used.

FIG. 10 illustrates an alternate platform 71 similar to that shown in FIG. 9 but having seven composite strips and nine tubular elements 64. Platform 71 includes square element 68, two U-shaped elements 70 and 72 and it further includes four smaller U-shaped elements 73.

Figure 11:
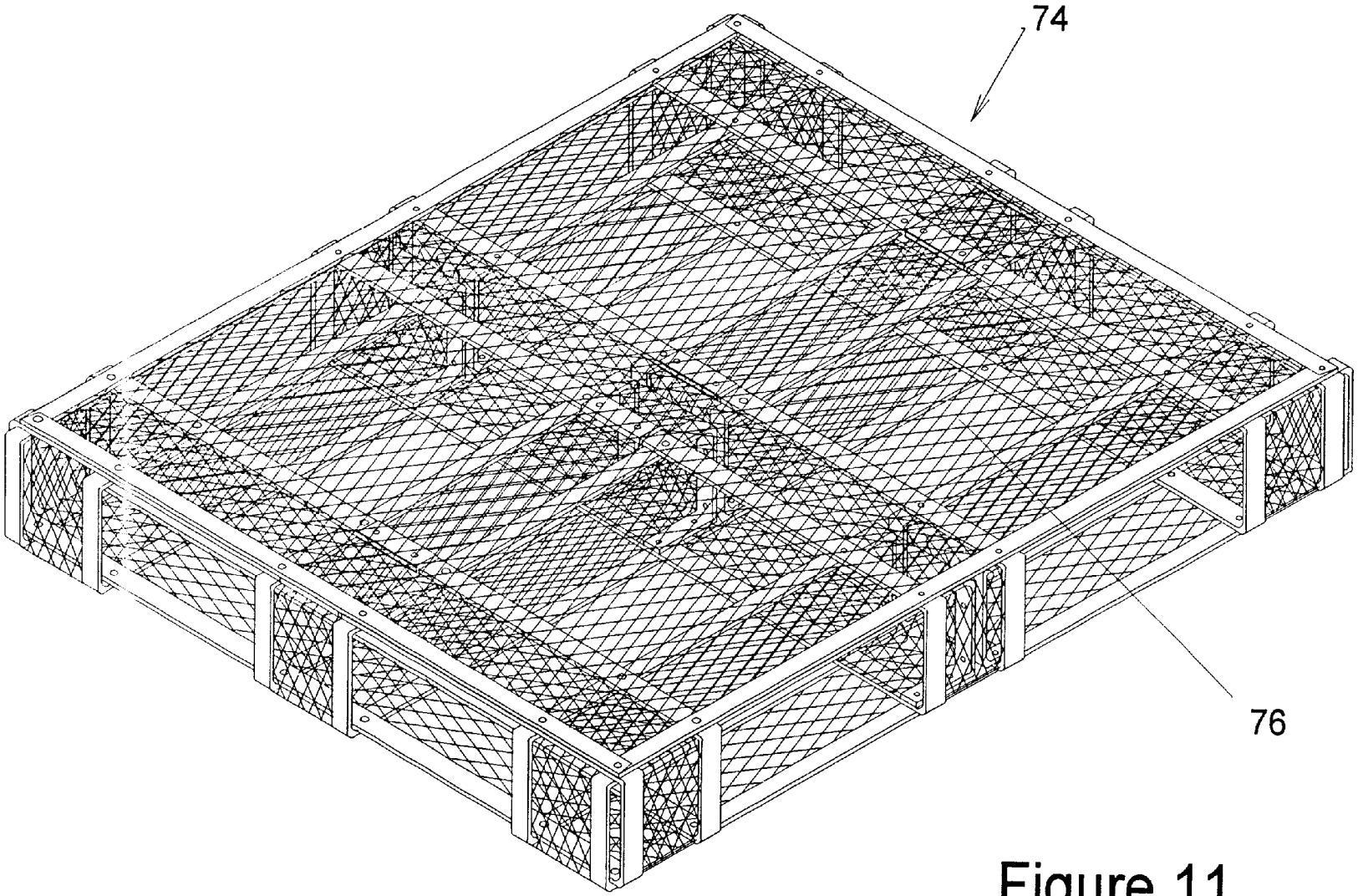
FIG. 11 is a perspective view of a pallet similar to the composite structure shown in FIG. 8 but including a composite panel.
Figure 12:
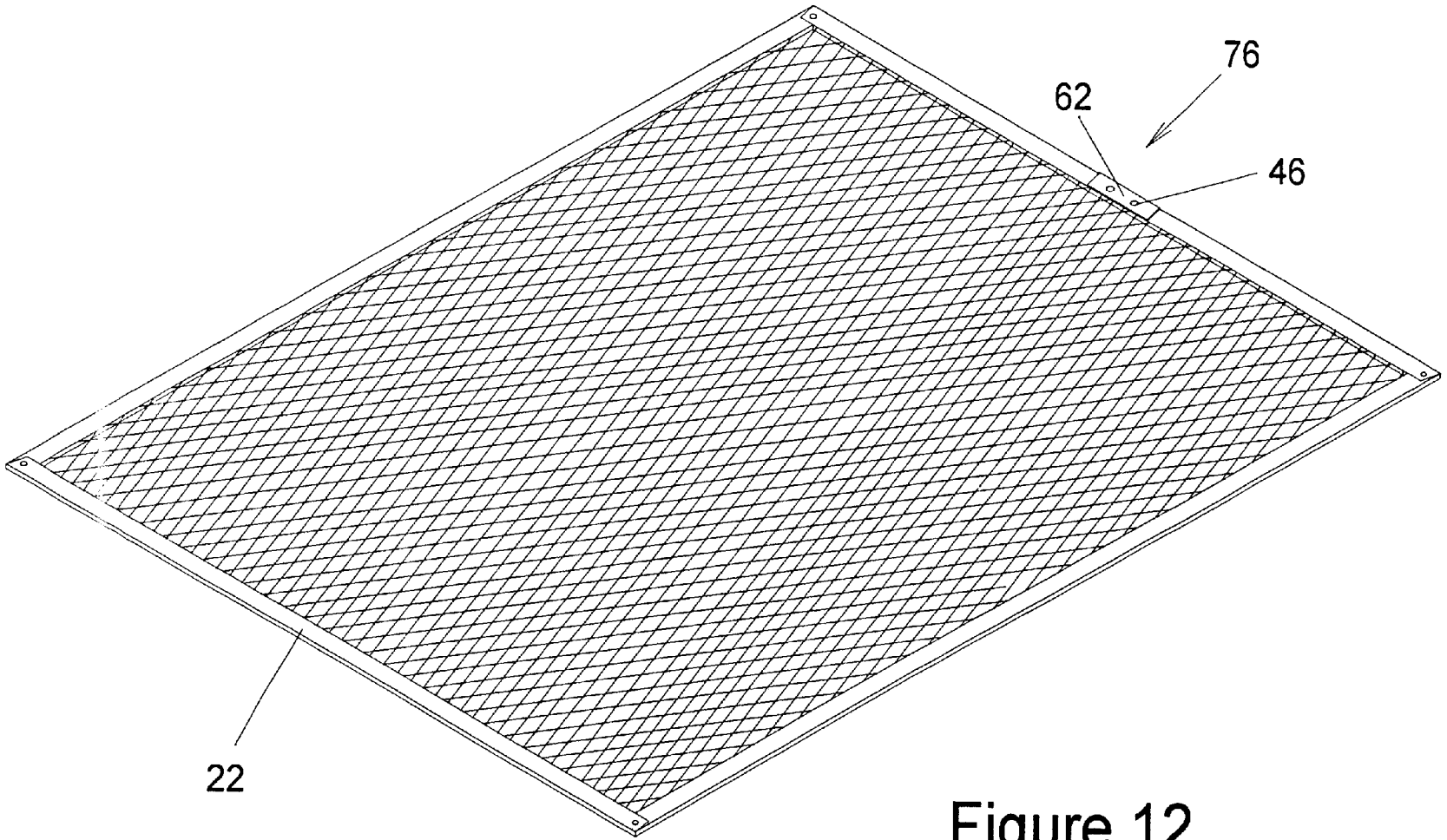
FIG. 12 is a perspective view of a composite panel.

FIG. 11 illustrates an alternate industrial platform or pallet generally shown at 74 which includes a rectangular composite panel 76 as illustrated in FIG. 12 assembled together with a composite structure assembly 56 shown in FIG. 8. This example is a grid-form pallet with an open deck.

Figure 14:
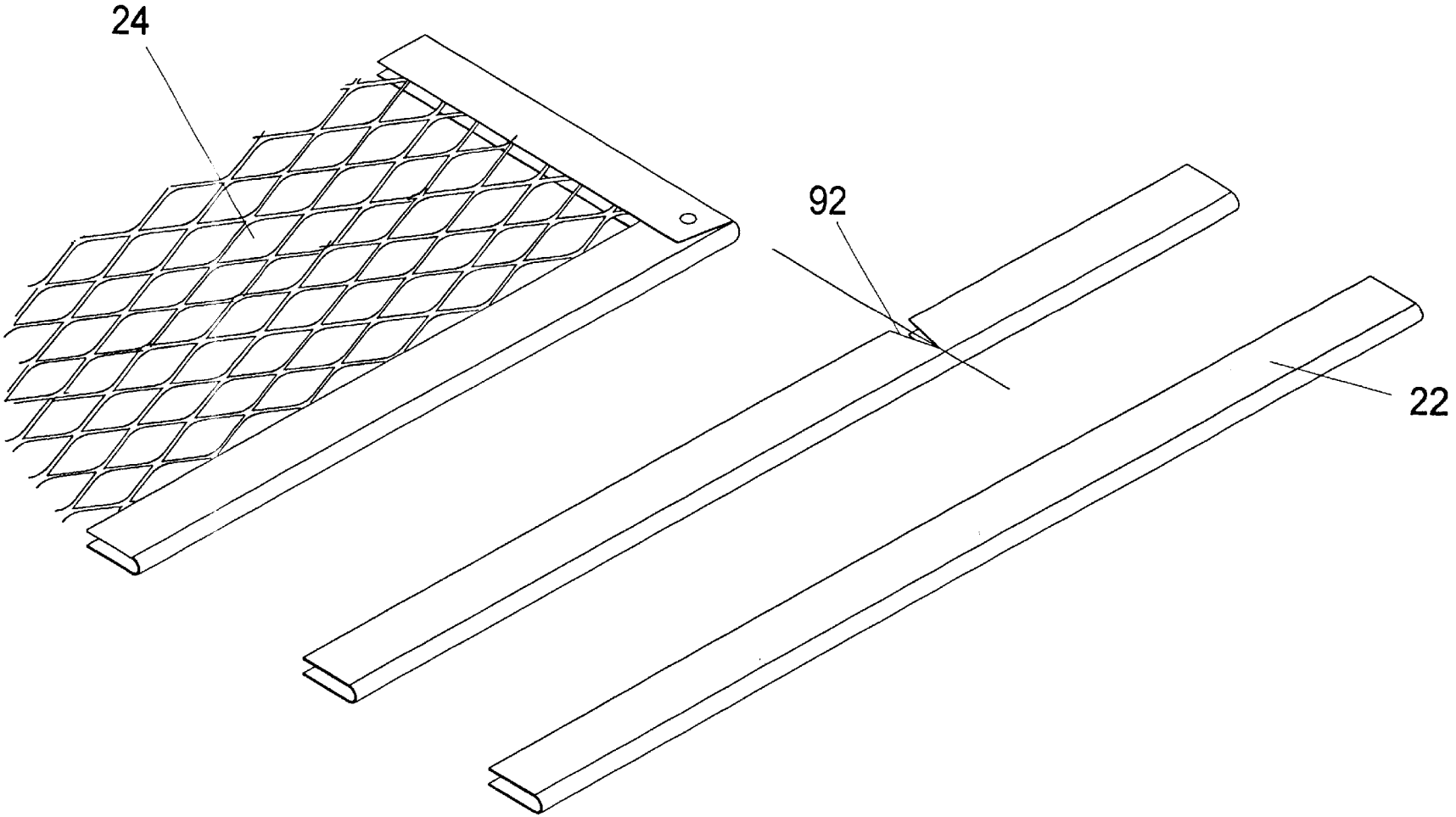
FIG. 14 is a perspective view of a method of forming the edge pieces on a web.

FIG. 12 shows a perspective view of a rectangular composite panel 76 which has "U-shaped" edge pieces 22. The edge piece of the rectangular composite panel 76 is formed from a U-shaped edge piece as shown in FIG. 14 and connected with a single end to end connector 62. The edge piece(s) may be attached to the web as described above with reference to FIG. 5. The panel is for use in an industrial platform 74. Alternatively this composite panel 76 may be bent into an rectangular or square shape in cross section or may be used flat as a panel and assembled with other structural elements, a preferred embodiment of which construction is shown in FIG. 11.

Figure 13:
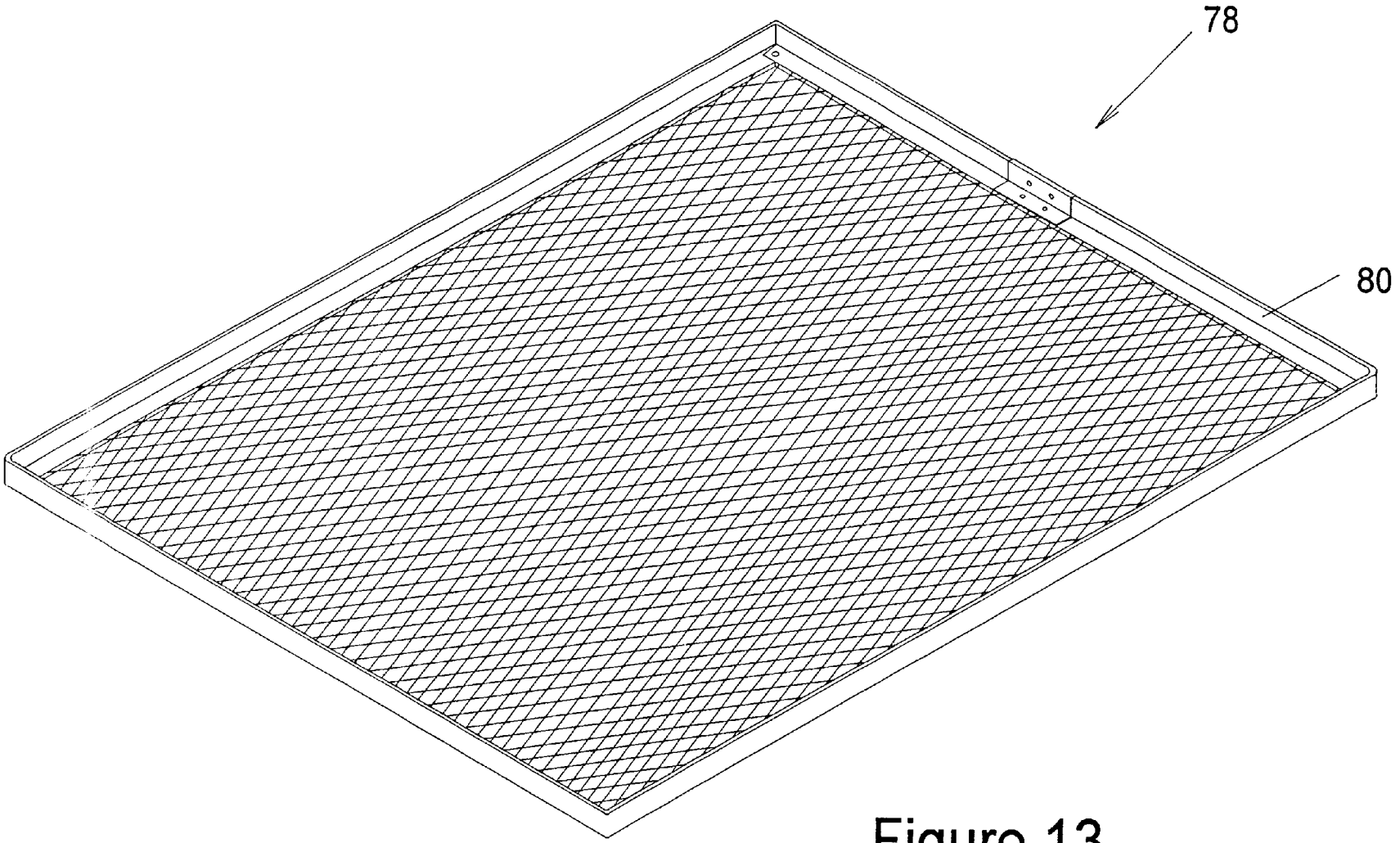
FIG. 13 is a perspective view of an alternate embodiment of a composite panel having L-shaped edge pieces.

An alternated embodiment of a rectangular composite panel is shown at 78 in FIG. 13. Rectangular composite panel 78 is similar to that shown in FIG. 12, but is formed with "L-shaped" edge pieces 80(shown in figure 5*d* and 5*f*.

FIG. 14 illustrates the two step production method whereby a single "U-shaped" edge piece 22 is used to form a continuous edge around a web element 24 with a plurality of sides. This may be used in place of four separate edge pieces 22. This construction method has the advantage of forming corners without sharp edges, thereby improving safety in handling. First, the edge piece 22 is notched 92, then bent around the web 24. A 90-degree angle bend is shown. The corners are pierced and riveted holding the assembly together. An end-to-end connector 62, shown in FIG. 12, is located where the two ends of the edge pieces 22 meet, then pierced and riveted 46 to complete the assembly 76. The "L-shaped" edge 80 piece may also be formed in a similar way to produce a panel 78 as shown in FIG. 13.

Figure 15:
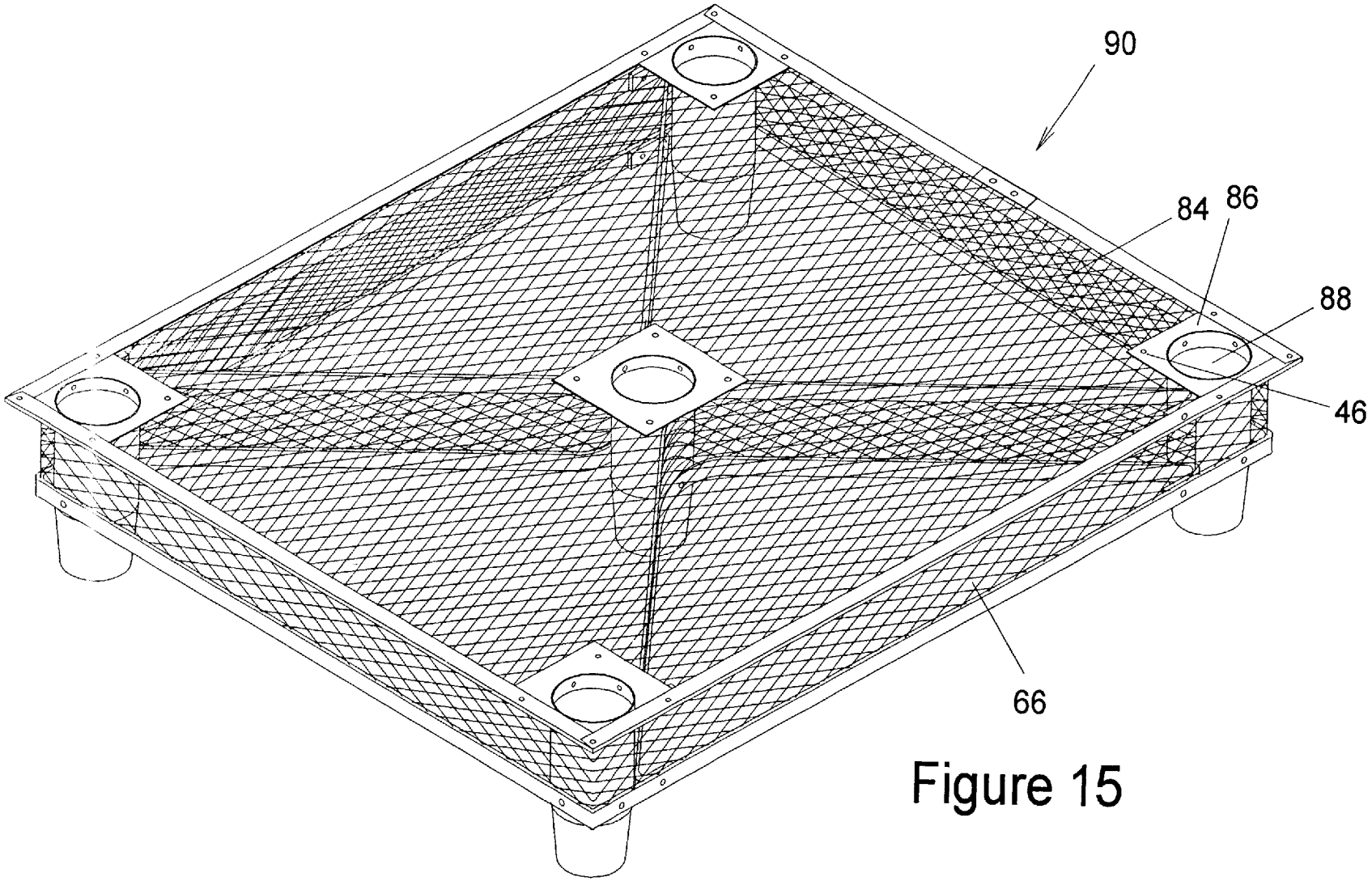
FIG. 15 is a perspective view of an elevated pallet similar to elevated composite structure shown in FIG. 9 but including a composite panel.
Figure 16:
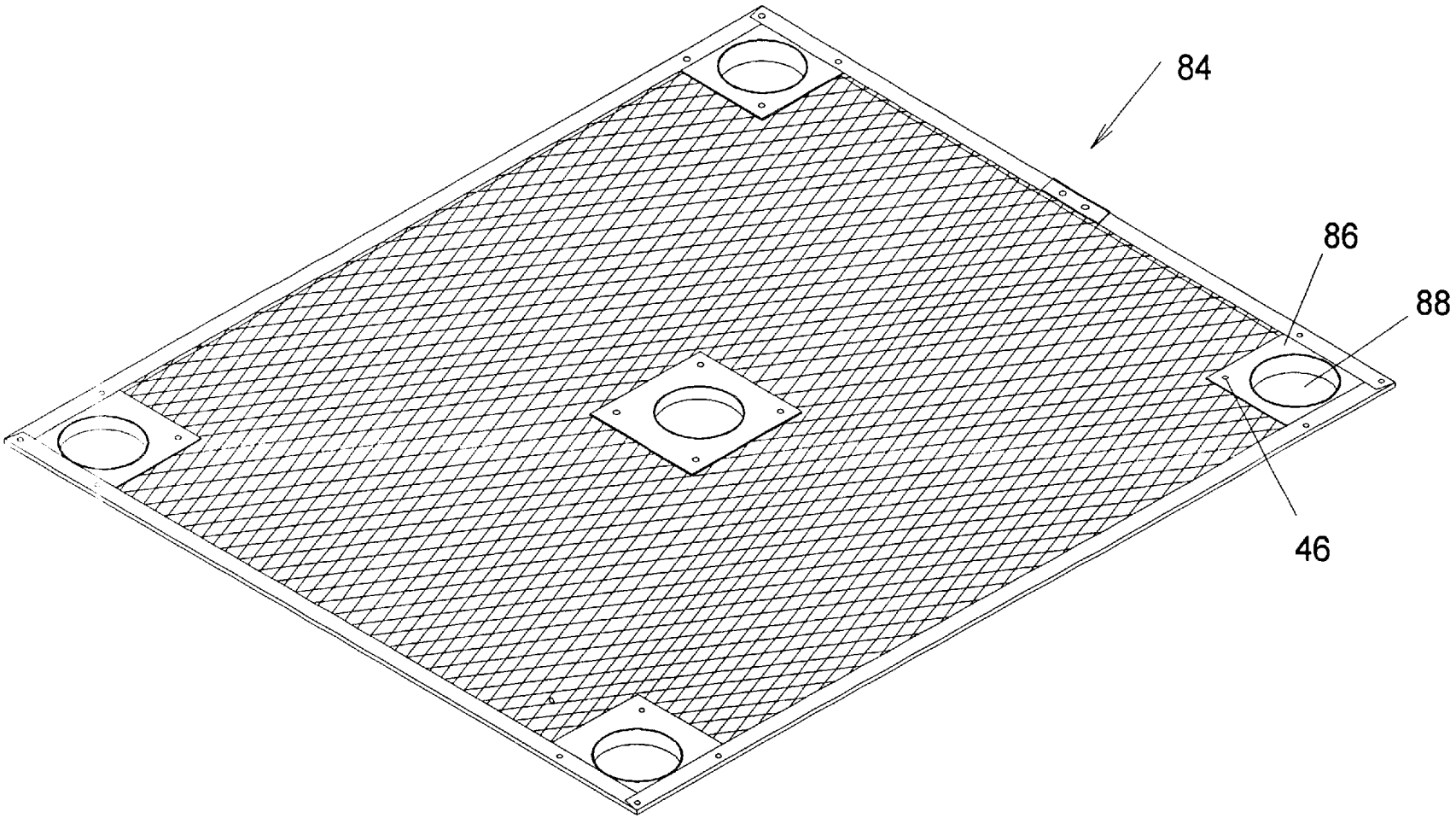
FIG. 16 is a perspective view of an alternate embodiment of a composite panel having reinforcing elements attached thereto.

FIG. 15 shows an elevated composite structure assembly 90 including the platform 66 shown in FIG. 9, but with rectangular composite panel 84 . The rectangular composite panel 84, shown by itself in FIG. 16, is fitted with pressed or spin-formed reinforcing elements 86 with apertures 88. This construction allows two pallets to be nested, one over and inside another to conserve storage space. Also rivets 46 are shown within the reinforcing elements 86. These serve to connect the panel assembly to the composite structure. The rectangular composite panel 84 is assembled together with an elevated composite structure to form a structure such as an industrial platform or pallet.

FIG. 16 illustrates a rectangular composite panel 84 fitted with pressed or spin-formed reinforcing elements 86 with apertures 88 for use in association with a composite structure such as the one described above, which is an example of a nest-able grid-form pallet. Panel 84 allows openings to be made in the web 24 of the panel. The apertures 88 provide openings for the tubular legs. The reinforcing elements 86 may be incorporated into the tubular elements 64 and constructed in such a way as to form as a single piece.

Figure 17:
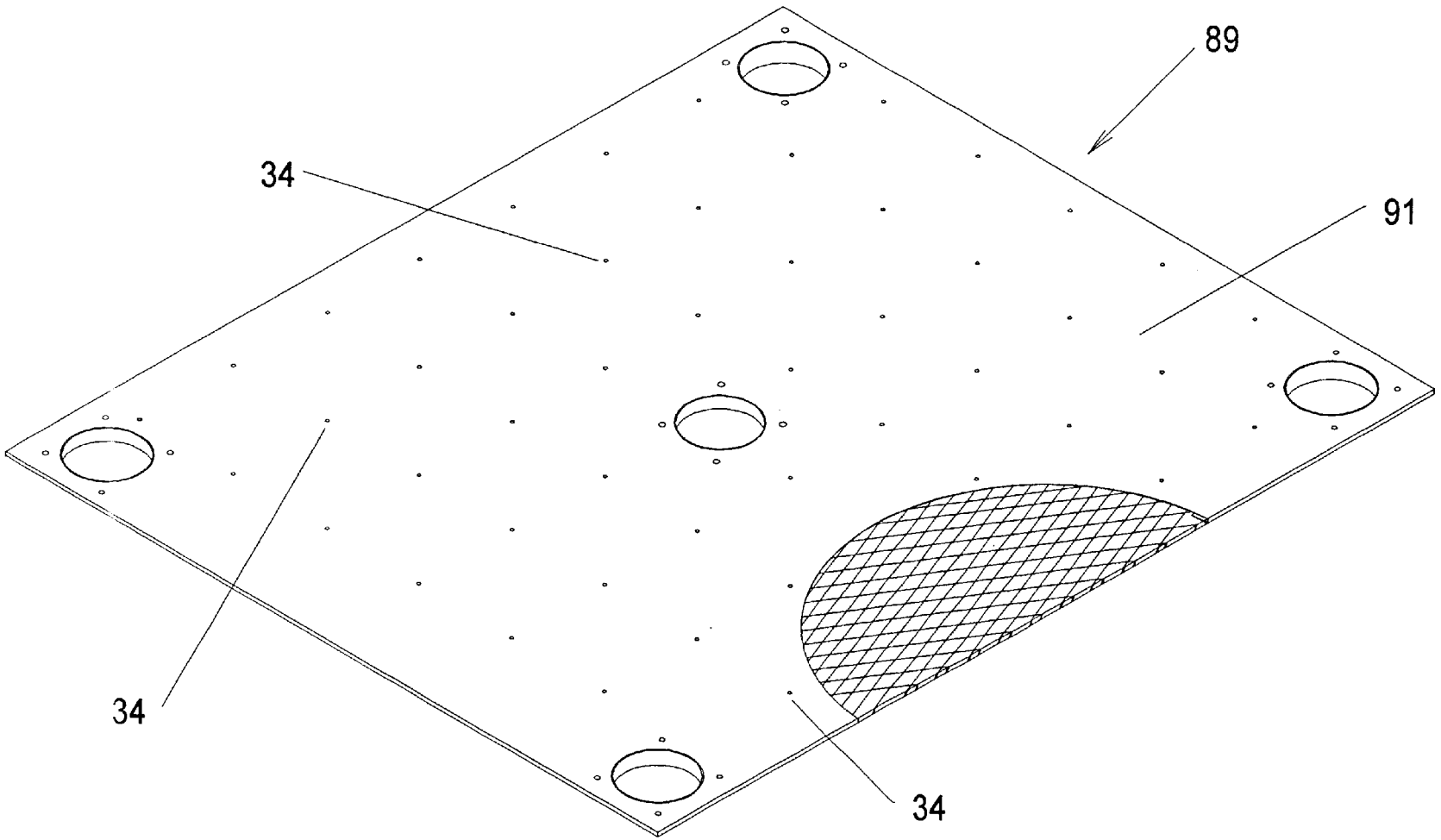
FIG. 17 is a perspective view of a second alternate embodiment of a composite panel having a top deck attached thereto.

FIG. 17 illustrates a rectangular composite panel 89 fitted with pressed or spin-formed reinforcing elements (not shown) with apertures and which is overlaid with a smooth sheet metal deck 91. The edge pieces are incorporated and become a part of the sheet metal deck 91. The reinforcing elements are located under the deck 91. Composite panel 89 provides a clean, smooth surface for applications with hygienic requirements. Here the assembly could be entirely fabricated from stainless steel.

Figure 18:
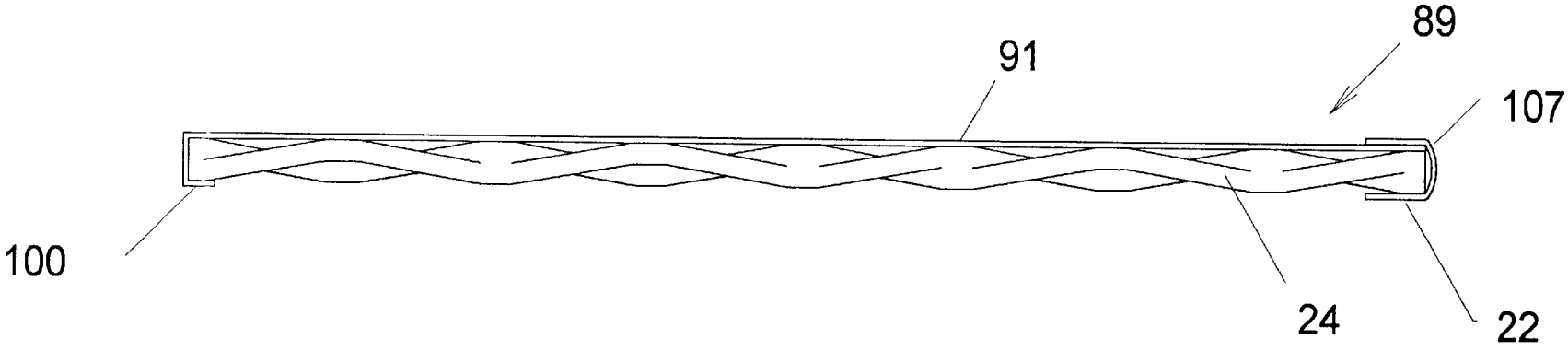
FIG. 18 is a cross sectional view of the composite panel of FIG. 17.
Figure 19:
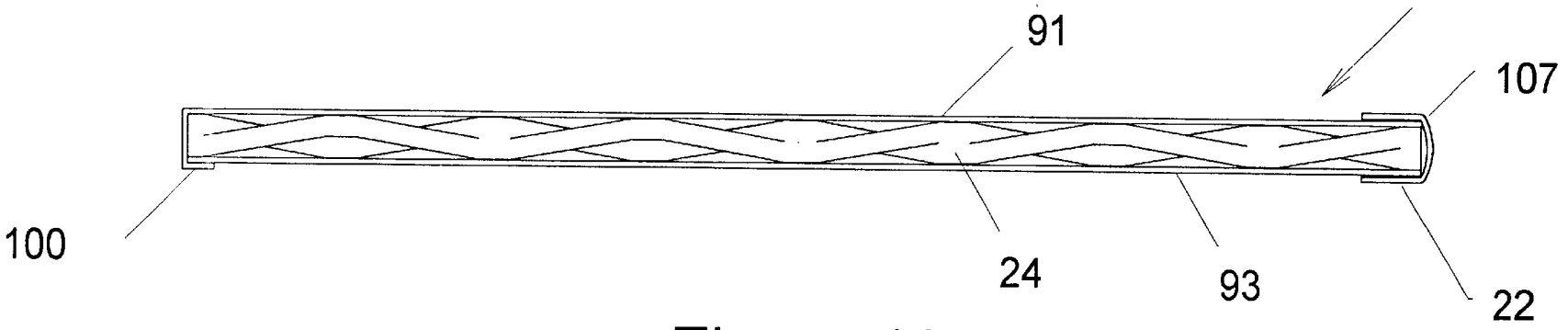
FIG. 19 is a cross sectional view of a third embodiment of a composite panel having a top deck and a bottom sheet.

Referring to FIGS. 18 and 19 there are a number of methods of attaching the sheet metal deck 91 to the web 24 in panel 87. For example sheet metal deck 91 is placed on top of the web 24 and the edges are bent around the web in a fashion similar to U-shaped edge pieces as shown at 100. Alternatively deck 91 is placed on top of the web 24 and a separate U-shaped edge piece 22 holds it in place as shown at 107. Alternatively, panel 87 includes in addition to sheet metal deck 91 which is positioned on top of the web 24, a bottom metal sheet 93. The sheet metal deck may have its edges folded over as shown at 100 or it may be secured with a U-shaped edge piece 22 as shown at 107. There are a variety of methods of securing the sheet metal deck 91 to web 24. For example the peripheral edges may be crimped, spot welded or riveted or a combination of both as described above with reference to FIG. 5. Alternatively a plurality of spot welds wherein the web 24 is welded to deck 91 or web 24 to deck 91 and bottom sheet 93 as shown in FIG. 17. Preferably the spot welds are at the bond points on the expanded metal web 24, that is where two strands of the expanded metal meet.

Figure 20:
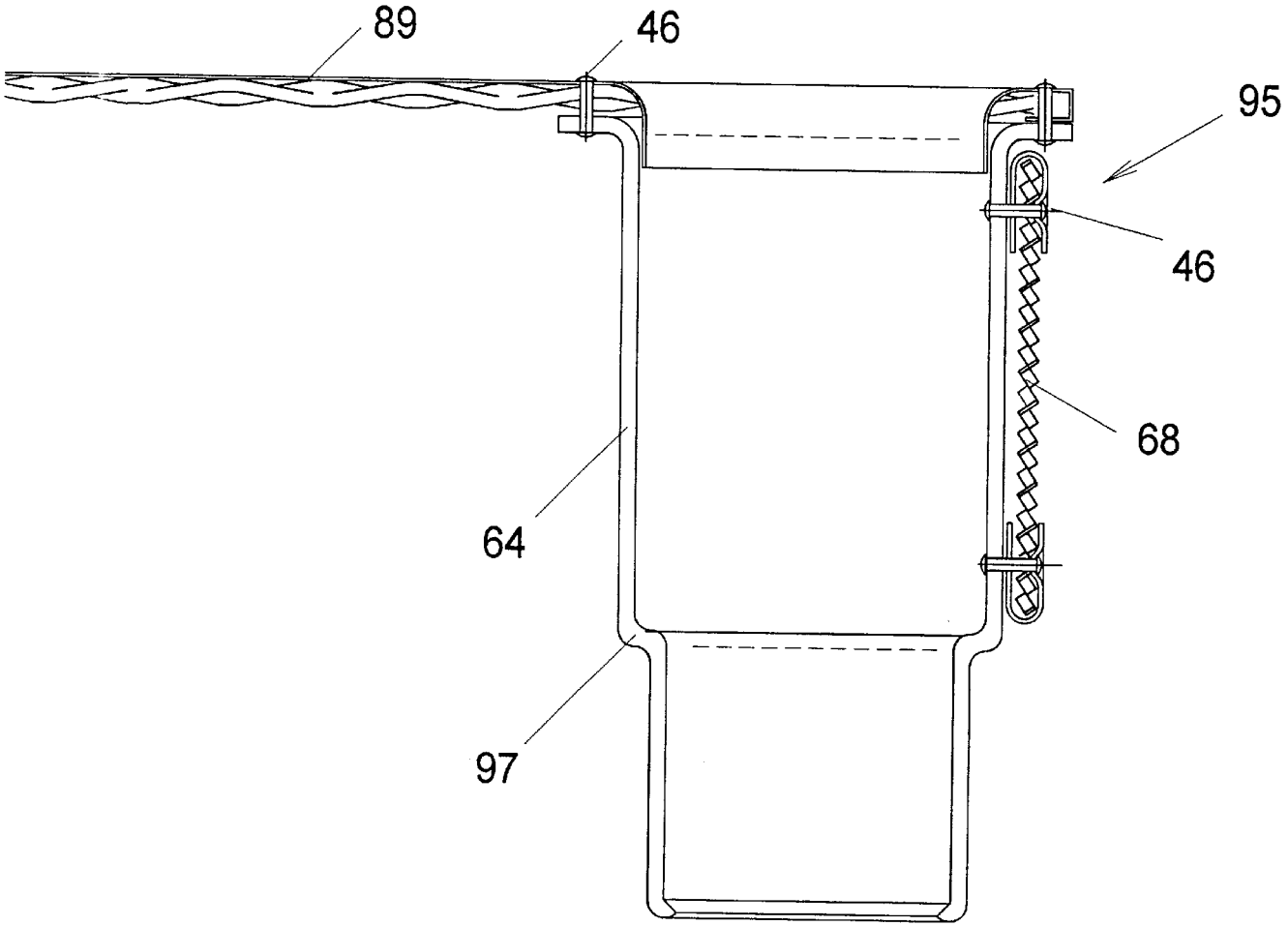
FIG. 20 is a cross sectional view of an elevated pallet with a composite panel having a top deck.

Referring to FIG. 20 a composite metal structure 95 is shown in cross section. Metal structure 95 includes a platform 66 or 71 and composite panel 89. The element of platform 66 shown herein include square element 68 and tubular element 64. The elements are riveted 46 together. Tubular element 64 includes a step 97 to facilitate stacking of composite metal structures 95.

Figure 21:
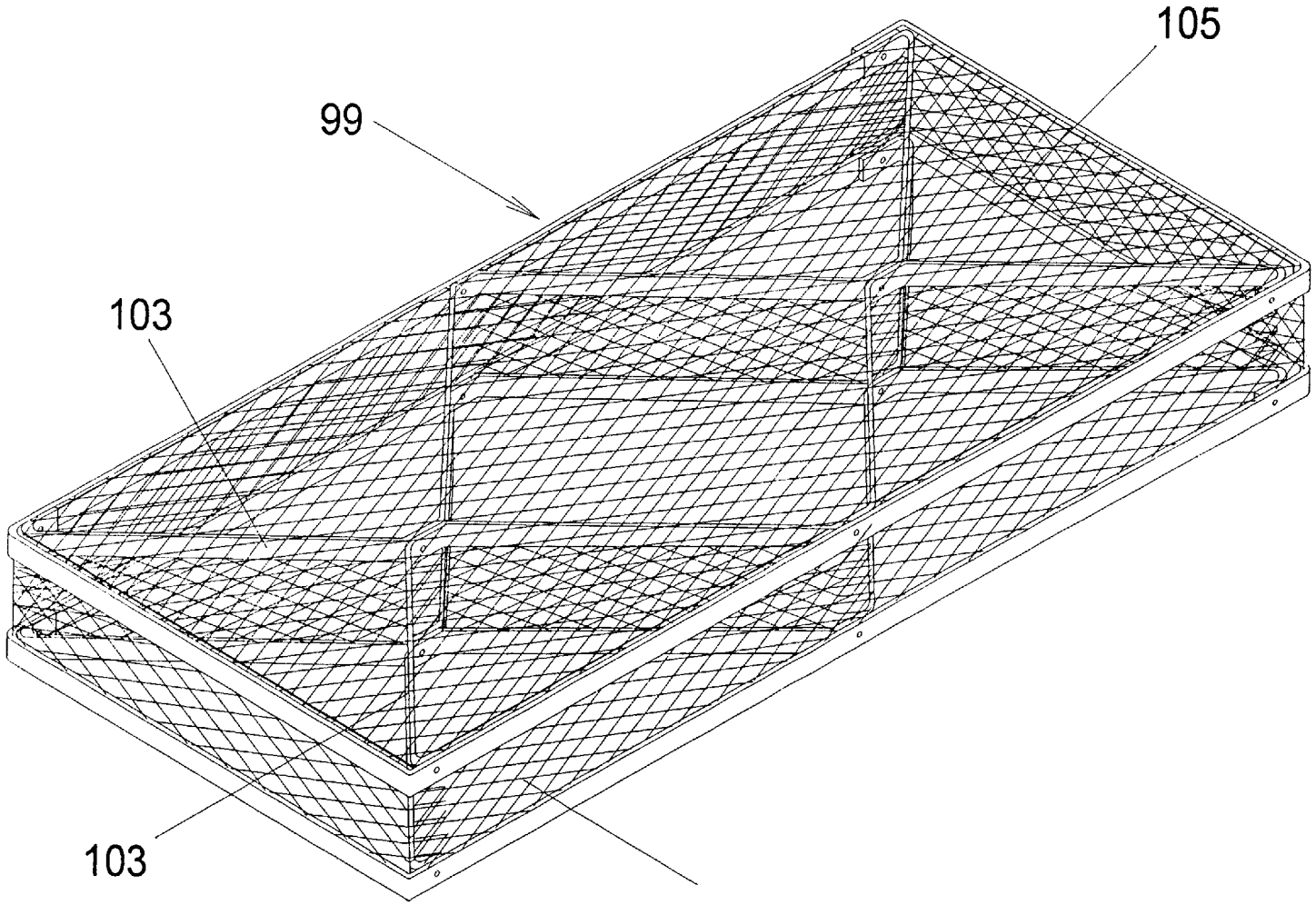
FIG. 21 is a perspective view of a second alternate embodiment of a composite metal structure.

FIG. 21 illustrates another composite metal structure 99. A plurality of metal structures 99 could be used as a floor. Metal structure 99 includes a rectangular element 101, a plurality of reinforcing elements 103 and a top rectangular panel 105. The elements are connected together as described above.

Figure 22:
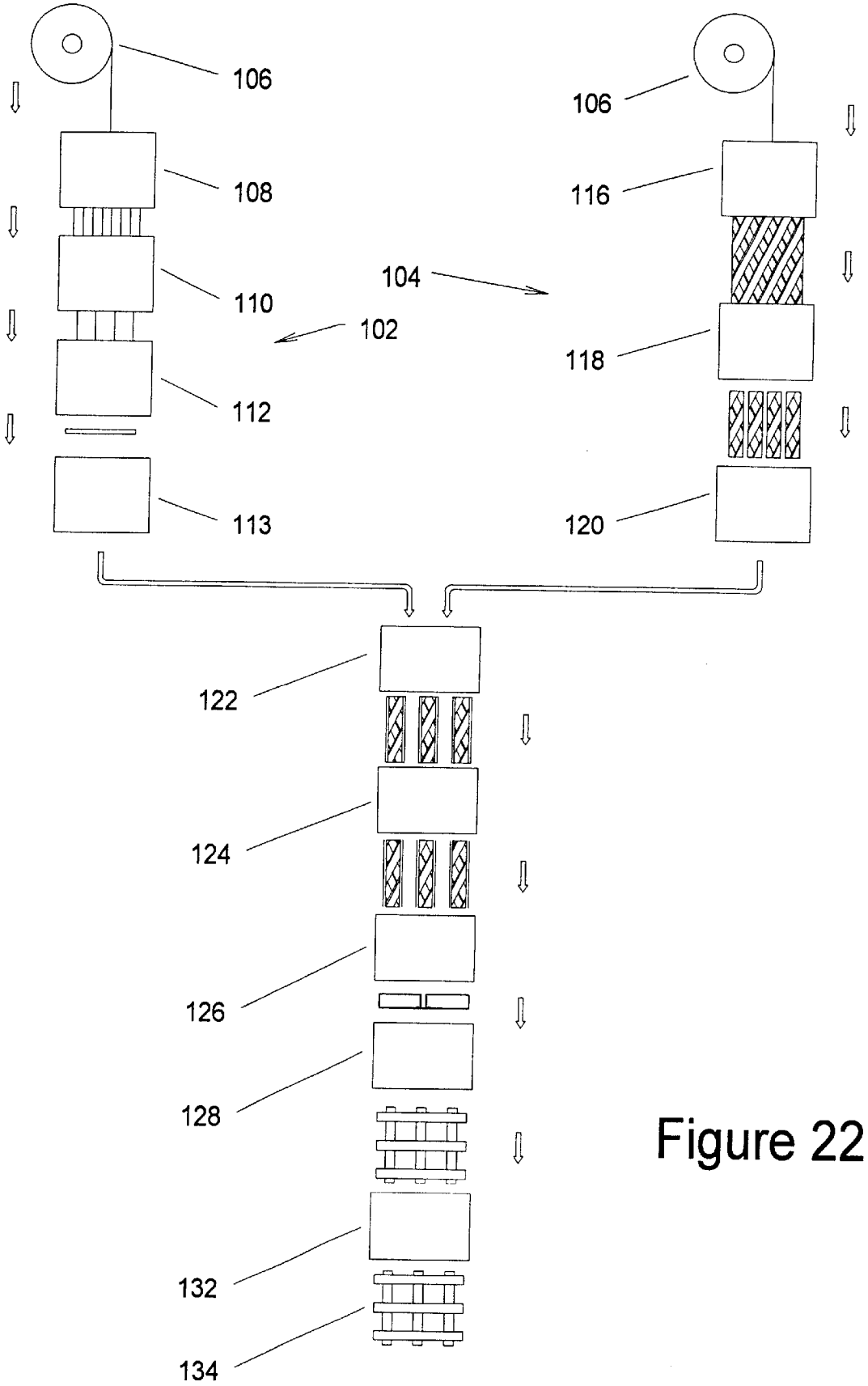
FIG. 22 is a schematic diagram showing the production of one embodiment of a three-dimensional structural assembly according to the present invention.

FIG. 22 is a schematic diagram showing the production of one embodiment of a three-dimensional structural assembly according to the present invention. The process for producing edge pieces is shown generally at 102 and the process for producing expanded metal webs is shown generally at 104. In order to produce edge pieces, sheet metal is fed into sheet metal coil and straightener 106 and transferred to slitter station 108 and then to edge forming rolling station 110. Elongate edge pieces produced in this manner is transferred to cutter station 112 where the edge pieces are cut into a desired size, and then collected in assembly station feeder 113.

In order to produce the expanded metal webs, sheet metal is fed into sheet metal coil and straightener 106 and then transferred to expanded metal press 116 where the sheet metal is expanded. The expanded metal web is then subject to shearing 118 and then collected in assembly station feeder 120.

The edge pieces and expanded metal web are both passed through bar assembly station 122 and then transferred to edge crimping/spot welding station 124 where the edge pieces are attached to the webs by crimping or spot welding to form composite metal strips. These metal strips are transferred to rotary bending station 126 where each of them is bent at eight locations to form an integral two-block box shaped structural element. The structural elements are transferred to assembly jig and punching/riveting station 128 where they are aligned, drilled and riveted to produce an assembly. The assembly is passed through coating and finishing station 132 to manufacture the finished product 134 which can be used as a grid-form pallet or platform.

Figure 23:
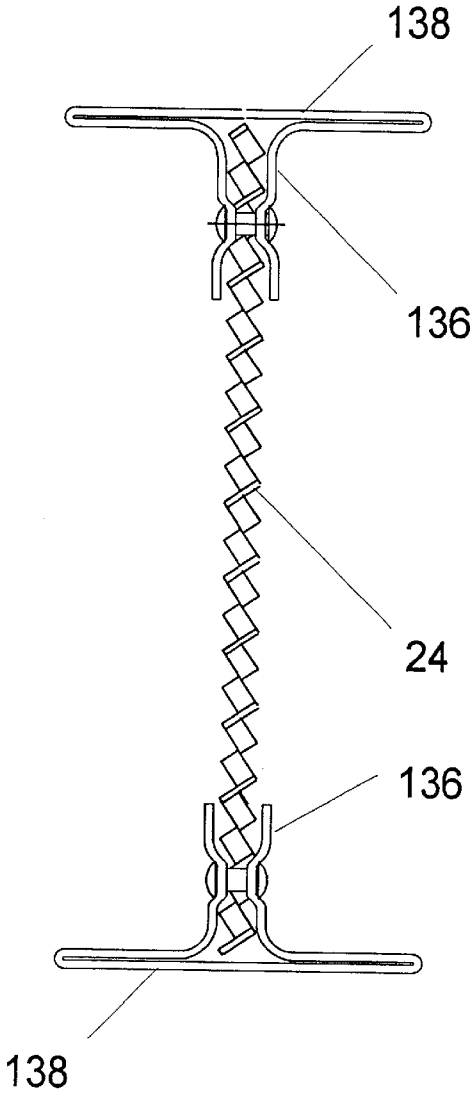
FIG. 23 is a cross sectional view of an H-shaped composite strip.
Figure 24:
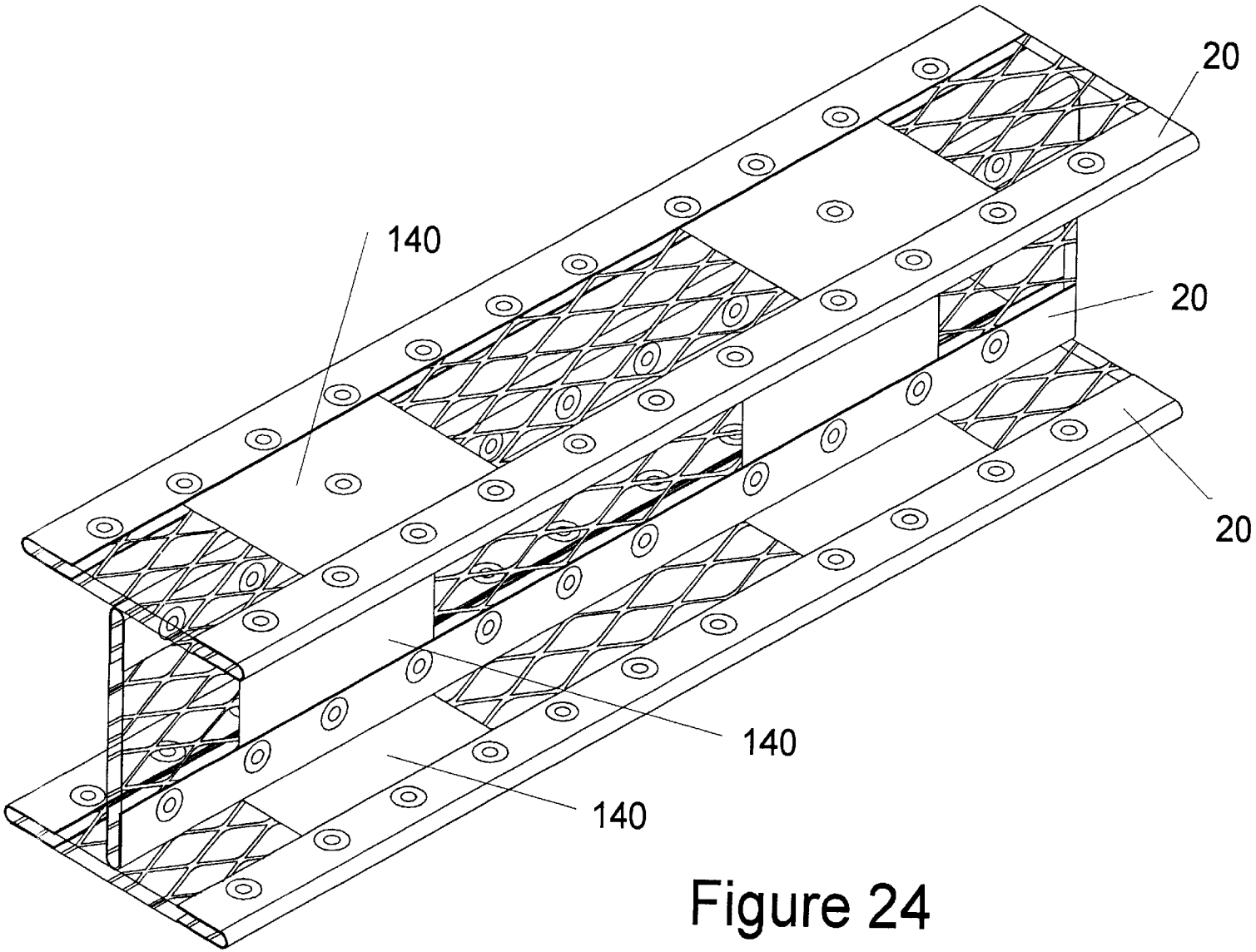
FIG. 24 is a perspective view of an H-shaped composite structure assembled from three composite strips.

There are almost a limitless number of configurations in which the composite strips of the present invention may be used. These configurations include composite strips with transverse bends therein, straight composite strips or a combination of both. FIGS. 23 and 24 show two such examples wherein straight composite strips of the present invention are used to form H-beams. Referring to FIG. 23 T-shaped edge pieces 136 are shaped such that there is a flat portion 138 which is orthogonal to the web 24. Alternatively, referring to FIG. 24, three composite strips 20 are connected such that they form an H. Reinforcing pieces 140 are positioned over the web to provide a connection surface. It will be appreciated by those skilled in the art that a number of different configurations could also be constructed. T-shaped members and C-shaped members are two such examples.

Figure 25:
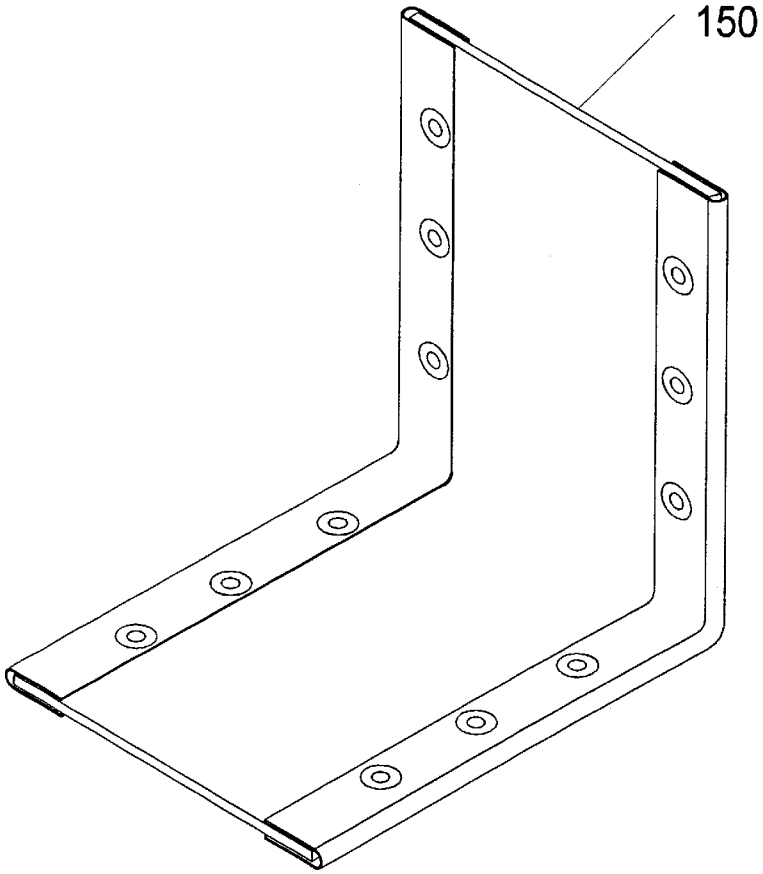
FIG. 25 is a perspective view of a composite strip having one transverse bend therein similar to that shown in FIG. 1 but having a solid sheet metal web.
Figure 26:
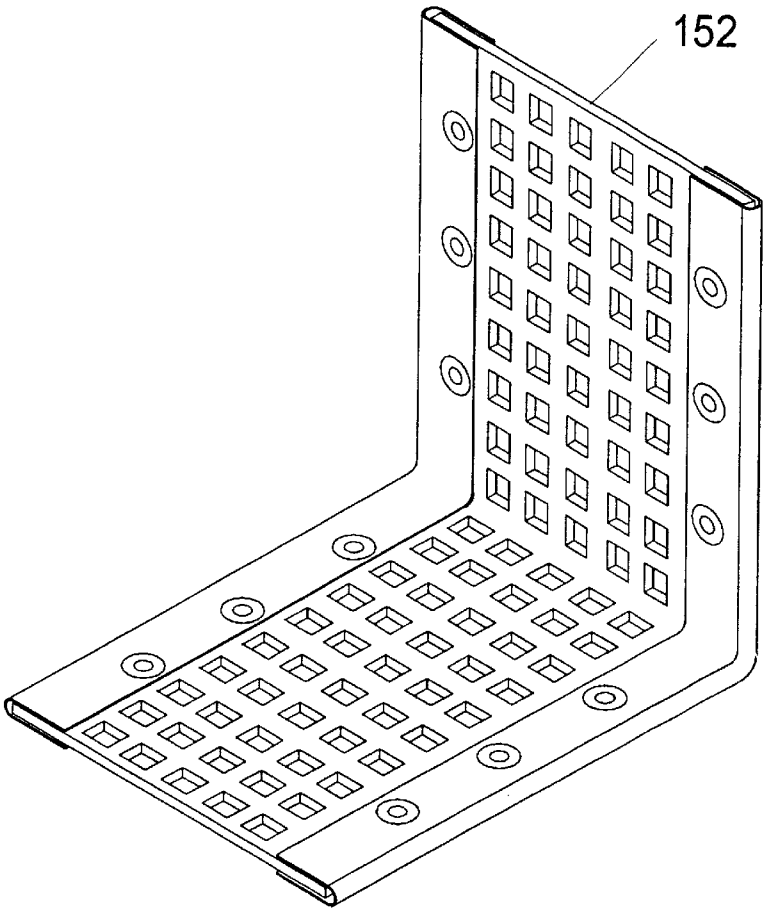
FIG. 26 is a perspective view of a composite strip having one transverse bend therein similar to that shown in FIG. 1 but having a pierced sheet metal web.
Figure 27:
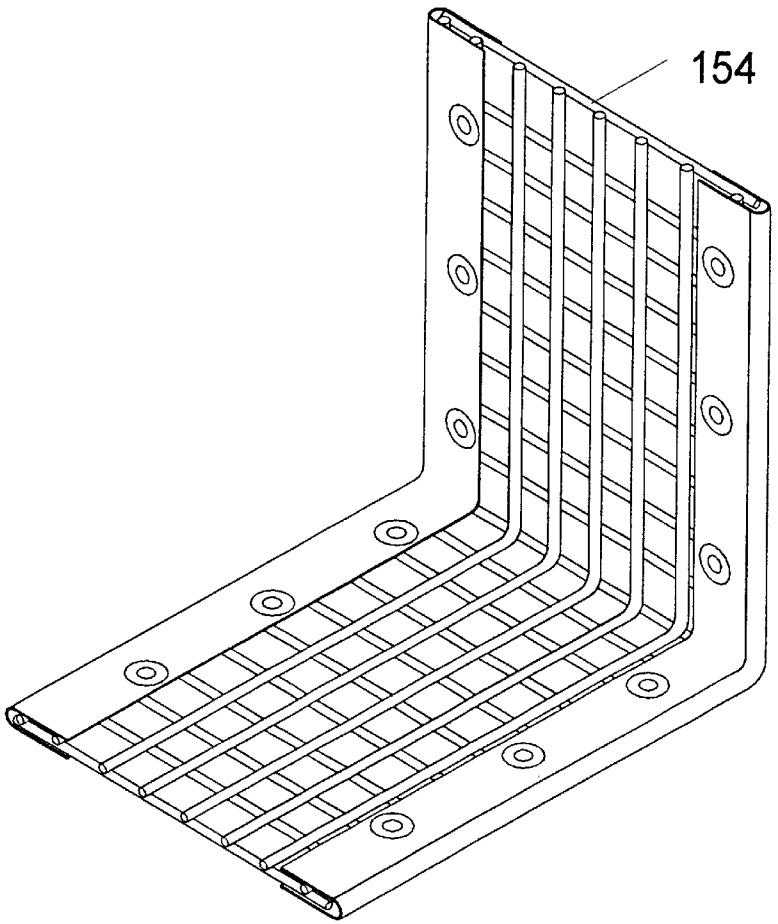
FIG. 27 is a perspective view of a composite strip having one transverse bend therein similar to that shown in FIG. 1 but having a wire mesh web.
Figure 28:
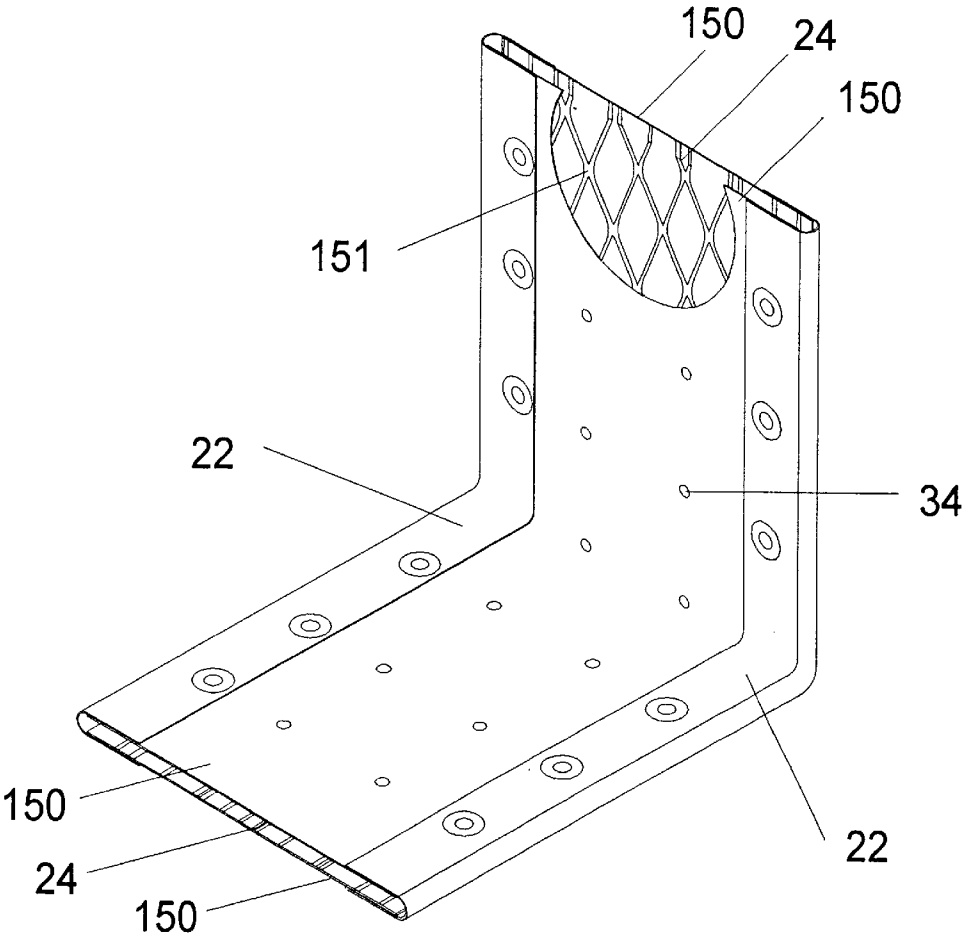
FIG. 28 is a perspective view of a composite strip having one transverse bend there similar to that shown in FIG. 1 but having a combination sheet metal and expanded metal web.

There are a number of significant variations to the method and apparatus of the invention to achieve a wide variety of composite structures. For example, the expanded metal web 24 could be replaced by a solid sheet metal, 150 shown in FIG. 25, pierced sheet metal 152 shown in FIG. 26, metal mesh 154 shown in FIG. 27 or a combination sheet metal 150 and expanded metal 24 shown In FIG. 28. The metal mesh can be either welded or woven. The combination sheet metal 150 and expanded metal 24 web could have a plurality of spot welds 34 at the bond points 151 at the intersection of two strands. Alternatively the assembly shown in FIG. 28 is held together by the edge pieces 22 and no spot welds are required.

It will be appreciated by those skilled in the art that a number of alternate materials could also be used for the web or the edge pieces. For example pierced metal or wire mesh or thin solid metal could be used for the web.

To summarize, the present invention has been developed to solve the existing problems that expanded metal is normally unsuitable for structural applications due to its dimensional instability. It has been discovered that by adding relatively stiff edge pieces to expanded metal strips, and then bending and assembling the composite strips, dimensionally stable and useful light weight structures can be created.

By way of example, the advantages of the invention are described below in terms of its application to the fabrication of materials handling pallets or industrial platforms.

The use of steel, or other metals, appears to offer considerable benefits over wood and plastic for the construction of pallets for storage and transportation. These benefits include, greater durability (longer useful life), higher strength (lower weight) uniform and reliable structural characteristics and greater recycle-ability.

The paucity of metal pallets available in the market place and a review of the "prior art" suggest that designs for pallets using metals have not exploited the material to its best advantage. The use of modem steel manufacturing methods and computerized mass production methods and the use of modem high-strength steels are expected to allow greater pallet strength with a lower weight than is possible with either wood or plastic and to simultaneously achieve lower production costs.

Because of its great strength, steel construction is expected to provide considerably longer useful pallet life and greater durability. Also steel or metal pallets have a significant advantage over wood, the most common construction material for pallets, in that steel has uniform and reliable structural characteristics while wood exhibits a considerable variability even within a single species, due to grain, knots and moisture content. One of the greatest difficulties of steel pallets is high weight and high cost. One of the key advantages of the present invention is that it provides the benefits of steel construction without these problems. Expanded metal can shed up to 80% of the weight of an equivalent gauge of metal while increasing the stiffness. This is due to the vertical deformation of the steel sheet. By reducing the weight of the steel the cost is reduced. The primary difficulty of expanded metal is its dimensional instability. This difficulty can be eliminated as shown in the present invention by the use of edge pieces, bending of the composite strips and the assembly of structural elements into composite structures.

Additionally, lower weight will reduce the cost and energy requirements of the transportation of goods and improve the "environmental friendliness" of the pallets. Also metals such as steel are among the most recyclable of materials, further improving the environmental benefits of the use of these steel pallets.

Further, the use of steel, or other metals, in construction of pallets offers additional benefits such as improved wash-ability for hygienic applications, reduced fire hazard, better low and high temperature performance and effective for heating and cooling applications (high open area for ventilation, high thermal conductivity and lower mass and specific heat than wood and plastic). With the use of stainless steel for construction, pallets can be constructed with the hygienic and low cost wash-ability characteristics where required. Other additional benefits of the use of metals are improved high and low temperature performance (for example, suitable for products requiring loading into furnaces or for use in arctic environments). Specialized steel formulations or other metals may be used for pallets requiring no sparking for hazardous conditions or specialized resistance to corrosive conditions for radioactive or hazardous materials storage.

From the same basic technology, a variety of alternative designs can be produced to meet market requirements, for example, nest-able, rack-able, open deck, closed deck, corrosion resistant, suitable for high and low temperatures or changing temperatures, non-moisture absorbent, and sterilizable.

Though the invention was primarily developed for use with metals such as steel, it may be applied to mixtures of materials such as an expanded plastic web and metal edges.

It will be appreciated that the above description related to embodiments by way of example only. Many variations on the invention will be obvious to those skilled in the art and such obvious variations are withing the scope of the invention as described herein whether or not expressly described.

Therefore what is claimed is:

1. A three-dimensional metal structural assembly comprising at least one composite strip including a web consisting of expanded material having a pair of longitudinal edges, a pair of edge pieces attached to the longitudinal edges for strengthening the composite strip, wherein said composite strip has at least one bend transverse to the longitudinal axis therein to form a structural element.

2. The three-dimensional structural assembly according to claim 1 wherein the structural element has a plurality of transverse bends therein.

3. The three-dimensional structural assembly according to claim 2 wherein the plurality of bends of the structural element are arranged such that structural element is generally a parallelogram with a central support and the central support being formed from opposed ends of the composite strip attached together.

4. The three-dimensional structural assembly according to claim 2 further including a plurality of structural elements each having a plurality of bends therein and having opposed ends of each composite strip attached together thereby forming a generally a parallelogram structural element and the generally parallelogram structural elements being interwoven thereby forming a grid-form industrial platform.

5. The three-dimensional structural assembly according to claim 4 further including a planar deck element including a deck web having four deck edges and a deck edge piece attached to each deck edge and the deck being attached to the grid-form industrial platform.

6. The three-dimensional structural assembly according to claim 5 wherein the deck edge pieces being one continuous edge piece having a notch and a bend at each corner of the deck web.

7. The three-dimensional structural assembly according to claim 5 wherein the deck further includes a planar sheet on the top thereof.

8. The three-dimensional structural assembly according to claim 7 wherein the planar sheet is integrally attached to the edge pieces.

9. The three-dimensional structural assembly according to claim 7 wherein the planar sheet is a top planar sheet and further including a bottom planar sheet.

10. The three-dimensional structural assembly according to claim 5 wherein the deck edge piece are generally L-shaped.

11. The three-dimensional structural assembly according to claim 4 wherein at least one of the plurality of generally a parallelogram structural elements have a central support.

12. The three-dimensional structural assembly according to claim 1 wherein the edge pieces are generally U-shaped.

13. The three-dimensional structural assembly according to claim 12 wherein each edge piece is attached to the web with an attachment means and the attachment means is chosen from a group consisting of crimping, welding, riveting, transverse bending, and bending back.

14. The three-dimensional structural assembly according to claim 12 wherein each edge piece is attached to the web with an attachment means and the attachment means is chosen from a group consisting of crimping and welding; crimping and riveting; transverse bending; crimping, riveting and lateral bending; bending back; and bending back and lateral bending.

15. The three-dimensional structural assembly according to claim 1 wherein the expanded material is chosen from a group consisting of expanded metal web, wire mesh, sheet metal and pierced metal.

16. The three-dimensional structural assembly according to claim 1 wherein the web has a pair of transverse edges and further including a pair of edge pieces attached to the transverse edges.

17. The three-dimensional structural assembly according to claim 1 further including at least another composite strip.

18. The three-dimensional structural assembly according to claim 1 wherein the composite strip has a plurality of transverse bends therein thereby forming a generally parallelogram structural element with one end of the composite strip bisecting the parallelogram and further including a plurality of reinforcing composite strips attached to the parallelogram structural element.

19. The three-dimensional structural assembly according to claim 18 further including a planar deck element including a deck web having four deck edges and a deck edge piece attached to each deck edge and the deck being attached to the parallelogram.

20. The three-dimensional structural assembly according to claim 1 wherein the composite strip is a first composite stip having one transverse bend therein and further including a second composite strip having one bend therein spaced from the first composite strip and a straight composite strip attached at opposed ends to the first and second composite strips.

21. The three-dimensional structural assembly according to claim 1 wherein the composite strip has a plurality of transverse bends therein thereby forming a generally parallelogram structural element and further including a plurality of vertical supports attached to the parallelogram structural element and extending downwardly therefrom thereby forming a pallet.

22. The three-dimensional structural assembly according to claim 21 further including a plurality of reinforcing composite strips attached at each end to one of the parallelogram structural element, vertical supports, and another reinforcing composite strip such that a top edge of the edge piece of each of the composite strips is co-planar.

23. The three-dimensional structural assembly according to claim 22 wherein each of the plurality of vertical supports is generally tubular.

24. The three-dimensional structural assembly according to claim 23 further including a planar deck element including a deck web having four deck edges and a deck edge piece attached to each deck edge and the deck being attached to the pallet.

25. The three-dimensional structural assembly according to claim 24 wherein the deck edge pieces being one continuous edge piece having a notch and a bend at each corner of the deck web.

26. The three-dimensional structural assembly according to claim 25 wherein the deck further includes a planar sheet on the top thereof.

27. The three-dimensional structural assembly according to claim 26 wherein the planar sheet is integrally attached to the edge pieces.

28. The three-dimensional structural assembly according to claim 26 wherein the planar sheet is a top planar sheet and further including a bottom planar sheet.

29. The three-dimensional structural assembly according to claim 24 wherein the deck edge pieces are generally L-shaped.

30. The three-dimensional structural assembly according to claim 24 wherein said deck further includes reinforcing elements having a plurality of apertures formed therein in registration with the plurality of tubular vertical supports.

31. The three-dimensional structural assembly according to claim 30 wherein said reinforcing elements are integrally attached to the tubular vertical supports.

32. The three-dimensional structural assembly according to claim 24 wherein said deck further includes a planar sheet having apertures formed therein in registration with the plurality of tubular vertical supports.

33. The three-dimensional structural assembly according to claim 1 wherein the web is a first web and further including a second web arranged orthogonally to the first web and wherein the edge pieces attached to the first web are attached to the second web.

34. The three-dimensional structural assembly according to claim 33 wherein the edge piece is attached to the first and second web and the shape of the edge pieces is chosen from a group consisting of a serpentine S-shape and a serpentine L-shape.

35. The three-dimensional structural assembly according to claim 33 wherein each edge piece includes a pair of elongate metal strips welded together and longitudinally bent.

36. A three-dimensional structural assembly comprising:

a deck consisting of a generally planar sheet having perimeter edges;

a web piece consisting of expanded material generally the same size as the deck and adjacent thereto;

edge pieces attaching to the deck and the web; and a bottom sheet generally the same size as the deck wherein the deck is on one side of the web and the bottom sheet is on the other side thereof.

* * * * *